US008009010B2

(12) United States Patent
Pentell et al.

(10) Patent No.: US 8,009,010 B2
(45) Date of Patent: Aug. 30, 2011

(54) WATER RESISTANT IN-LINE FUSE HOLDER

(75) Inventors: Christian Pentell, Forest Park, IL (US); John Adamczyk, Schaumburg, IL (US); Charles E. Klingler, Prospect Heights, IL (US)

(73) Assignee: Littlefuse, Inc., Chicago, IL (US)

( * ) Notice: Subject to any disclaimer, the term of this patent is extended or adjusted under 35 U.S.C. 154(b) by 0 days.

(21) Appl. No.: 12/646,370

(22) Filed: Dec. 23, 2009

(65) Prior Publication Data

US 2010/0164678 A1 Jul. 1, 2010

Related U.S. Application Data

(60) Division of application No. 12/126,461, filed on May 23, 2008, now abandoned, which is a continuation of application No. 11/425,348, filed on Jun. 20, 2006, now Pat. No. 7,377,813.

(60) Provisional application No. 60/741,987, filed on Dec. 2, 2005, provisional application No. 60/692,179, filed on Jun. 20, 2005.

(51) Int. Cl.
*H01H 85/02* (2006.01)
*H01H 85/175* (2006.01)

(52) U.S. Cl. ..... 337/205; 337/186; 337/187; 337/194; 337/198

(58) Field of Classification Search ..... 337/186, 337/187, 194, 198
See application file for complete search history.

(56) References Cited

U.S. PATENT DOCUMENTS

| | | | | | |
|---|---|---|---|---|---|
| 3,417,359 | A | * | 12/1968 | Angelo | 337/201 |
| 3,480,898 | A | * | 11/1969 | Giegerich | 337/4 |
| 4,107,639 | A | * | 8/1978 | Levy | 337/205 |
| 4,608,548 | A | * | 8/1986 | Borzoni | 337/201 |
| 4,648,674 | A | * | 3/1987 | Sanchez, Jr. | 439/395 |
| 4,830,631 | A | * | 5/1989 | Hsueh | 439/620.33 |
| 4,836,802 | A | * | 6/1989 | Phillips | 439/620.33 |
| 4,997,394 | A | * | 3/1991 | Katz et al. | 439/620.33 |
| 5,752,856 | A | * | 5/1998 | Boutin et al. | 439/620.29 |
| 5,820,413 | A | * | 10/1998 | Yamada et al. | 439/620.26 |
| 2003/0179070 | A1 | * | 9/2003 | Izumi | 337/255 |

* cited by examiner

*Primary Examiner* — Anatoly Vortman
(74) *Attorney, Agent, or Firm* — Kacvinsky Daisak PLLC

(57) ABSTRACT

Embodiments for an in-line fuse holder each include at least one housing and two mating pieces, which can snap-fit together and be held moveably together via a strap. Each embodiment houses at least one fuse, such as an automotive fuse. In one example, the fuse includes a first housing forming a first cavity, which is configured to house a first portion of the fuse. The first housing also includes a projection having sides that taper outwardly as the sides extend away from the first housing. The fuse holder also includes a second housing forming a second cavity, which is configured to house a second portion of the fuse. The second housing includes a channel having sides that taper outwardly as the sides extend into the second housing. The projection and channel snap-fit together in a water resistant relationship.

11 Claims, 14 Drawing Sheets

WATER RESISTANT IN-LINE FUSE HOLDER

CROSS-REFERENCE

This application is a divisional application of U.S. patent application Ser. No. 12/126,461 filed May 23, 2008, which is a continuation of Ser. No. 11/425,348 filed Jun. 20, 2006 and which claims the benefit of U.S. Provisional Patent Application No. 60/692,179, filed Jun. 20, 2005, entitled, "WATER RESISTANT IN-LINE FUSE" and U.S. Provisional Patent Application No. 60/741,987, filed Dec. 2, 2005, entitled, "WATER RESISTANT IN-LINE FUSE HOLDER," the entire contents of each of which are hereby incorporated by reference and relied upon.

BACKGROUND OF THE INVENTION

The present invention relates generally to overcurrent protection.

Plug-in type fuses, such as blade fuses, generally include a fuse link in electrical communication with a pair of terminals. The fuse element and terminals are housed in a plastic fuse body. The terminals extend out of the housing, so that the fuse may be mounted into a fuse block of an automobile. Such blade type fuses have become very popular, especially in automotive applications.

Recently, "low profile" blade fuses have been introduced. One such "low profile" blade fuse is described in U.S. patent application Ser. No. 11/076,101 ("the '101 application"), entitled "Low Profile Automotive Fuse", US 20050212647, filed Mar. 7, 2005, assigned to the assignee of the present invention, the entire contents of which are incorporated hereby be reference. The fuse in the '101 application includes a pair of "low profile" terminals and an insulative housing that covers a portion but not all of the terminals. In particular, the housing covers an inner portion of the terminals but exposes the outer edges and at least a portion of the top edges of the terminals. The "low profile" nature of the terminals is possible because the female fuse block terminals is configured to connect the exposed outer edges of the "low profile" terminals instead of the portion of the terminals that extend beneath the housing for standard blade fuses. Low profile fuses are advantageous, at least in part, because they are less costly and require less space than do standard blade fuses.

With any type of blade fuse, moisture inadvertently contacting any conductive part of the plug-in fuse can cause problems. In an extreme situation, the moisture can extend across the terminals causing a second current path, which can negate the effectiveness of the element. Alternatively or additionally, the moisture can cause the terminals and/or the fuse element and corresponding female terminals to corrode. Corrosion of the male and female terminals can lead to a poor electrical connection and/or a connection between the male and female terminals that is difficult to disassemble.

Water resistant fuse holders are available. A typical use for such water resistant fuse holder is the aftermarket. Here, an automobile owner or servicer may add an electrical component to the automobile that requires a fuse. Interestingly, manufacturers also use a large amount of such water resistant fuse holders.

Existing water resistant fuse holders are relatively expensive. Further, no such holder exists for the "low profile" blades fuses described above. For these and other reasons, it is desirable to provide improved water resistant fuse holders.

SUMMARY OF THE INVENTION

Various examples for an in-line fuse holder are described in the following specification and drawings. The fuse holders are believed to provide cost savings and be configurable for different styles of fuses, such as standard blade fuses, low profile blade fuses, standard cartridge fuses, low profile cartridge fuses and the like.

The examples described in detail below each have certain features in common. For example, the embodiments each include at least one housing, which can be made from at least one material selected from the group consisting of plastic, rubber, etc., or any combination thereof. Each of the embodiments include two mating pieces, which can be configured to snap-fit together. The two mating pieces can also be held moveably together (with respect to each other) via a strap. Each of the embodiments house at least one fuse of a type selected from the list above.

In a first primary example, a fuse holder for a fuse includes a first housing forming a first cavity. The first cavity is configured to house a first portion of the fuse. The first housing has a first surface into which the first portion of the fuse is inserted. The first housing includes a projection having sides that taper outwardly as the sides extend away from the first surface. For example, if the first surface is an upper surface of the second housing, the sides taper outwardly as the projection extends upwardly from the upper surface of the first housing.

In this first primary example, the fuse holder also includes a second housing. The second housing forms a second cavity. The second cavity is configured to house a second portion of the fuse. The second housing has a second surface into which the second portion of the fuse is inserted. The second housing includes a channel having sides that taper outwardly as the sides extend into the second housing and away from the second surface. For example, if the second surface is a lower surface of the second housing, the sides taper outwardly as the projection extends upwardly from the lower surface of the second housing and into the second housing.

The projection and the cavity are sized and configured to mate with each other and hold the first and second housings together in a frictional and moisture resistant relationship. The tapering of the projection and the cavity is configured such that the housings can be snapped together and pulled apart without undo force and still provide an effective water resistant seal, which protects a fuse housed inside the holder.

The fuse holder receives and holds leads or wires that connect electrically with terminals of a fuse housed inside the holder. To this end, the fuse holder defines at least two apertures or lumens for at least two external leads. The apertures or lumens can be defined solely by the first housing, solely by the second housing or partially by the first and partially by the second housing.

In one implementation, the fuse is a typical automotive blade fuse, having two terminals connected electrically to a fuse element. An insulative body is fitted over the fuse element and an upper portion of the terminals. A lower portion of the terminals extends beneath the body, and it is this lower portion that makes electrical connection with an automobile circuit when the fuse is inserted into a fuse block. With the in-line fuse holder, the external leads are placed in contact with this lower exposed portion of each terminal. Here, at least one of the first and second cavities is configured in combination with the apertures or lumens so that the leads electrically communicate with the exposed terminals of the fuse, i.e., at points below the body of the fuse.

In another implementation, the fuse is a low profile type of automotive blade fuse, again having two terminals connected electrically to a fuse element. An insulative body is fitted over the fuse element and over at least substantially all of an inner portion of the terminals. Outer edges of the terminals are exposed, and it is the outer edges that make electrical connection with an automobile circuit when the fuse is inserted into a fuse block. At least one of the first and second cavities is configured in combination with the apertures or lumens so that the leads contact the exposed outer edges of the terminals of the fuse.

In a third implementation described below, this first fuse holder is also operable with a female cartridge fuse.

The mating projection and channel of the two housings of the holder can have any suitable shape, configuration and size. In various implementations, the projection and channel are both four-sided, wherein one, two, three or all four sides are tapered or chamfered. The tapered sides can be straight or curved and can be smooth, serrated, notched, jagged, toothed, ribbed or otherwise not smooth.

In a second primary example, a fuse holder for a fuse includes a first housing and a second housing. At least one of the first and second housings forms a cavity configured to house the fuse. That is, the fuse holding cavity may be formed in any one or both the first and second housings. The first housing includes a side that overlaps a side of the second housing and engages the side of the second housing along a bottom edge thereof. The engagement of the sides tends to hold the first and second housings together in a frictional and moisture resistant relationship.

As with the first example, the second fuse holder receives and holds leads or wires that connect electrically with terminals of a fuse housed inside the holder. To this end, the second fuse holder defines at least two apertures or lumens for at least two external leads. The apertures or lumens can again be defined solely by the first housing, solely by the second housing or partially by the first and partially by the second housing. Also, the apertures, the cavity and the housings can be configured so that the leads contact the terminals of a typical blade fuse, a low profile blade fuse or a female cartridge fuse.

The first housing may include multiple sides that overlap corresponding sides of the second housing and engage those sides of the second housing along bottom edges thereof. The engagement of each of the sides tends to hold the first and second housings together in a frictional and moisture resistant relationship. This second fuse holder can also include at least one additional side of the first housing that overlaps but does not engage an additional side of the second housing.

In a third primary example, a fuse holder for a fuse includes a housing defining a cavity, which is configured to hold a fuse. The housing further includes at least one side wall defining an opening. The opening enables the cavity to receive the fuse. A lid is provided and includes a projection that is configured to extend into the opening and engage the sidewalls of the housing. The engagement of the projection of the lid and the sidewall(s) of the housing tends to hold the lid to the housing in a frictional and moisture resistant relationship. A strap may be provided that connects the lid to the housing.

The housing as before defines first and second apertures or lumens enabling first and second external leads to be inserted into the housing so as to be in electrical communication with first and second terminals of the fuse. The apertures or lumens, the cavity and the housings can be configured so that the leads communicate electrically with the terminals of a typical blade fuse, a low profile blade fuse or a female cartridge fuse.

In a fourth primary example, a fuse holder for a fuse includes a housing defining a cavity, the cavity configured to hold the fuse, the housing: (i) defining an opening configured to enable the cavity to receive the fuse, and (ii) including a rim projecting from a surface of the housing, the rim including an inwardly extending lip projecting from an upper portion of an inner side surface of the rim. The holder also includes a lid having at least one sidewall extending downwardly from a top portion of the lid to an edge, the sidewall including an at least partially continuous tab extending outwardly around the at least one sidewall, the tab sized and configured to engage the inwardly extending rib of the rim so as to hold the lid to the housing in a frictional and moisture resistant relationship.

In this fourth primary example, a strap can connect the lid to the housing. The lip of the rim of the housing can be chamfered to provide flexibility. The rim of the housing can have at least one break. The tab of the lid can include at least one characteristic, such as: (i) forming a U-shape with the sidewall; (ii) being at least partially flexible; and (iii) being completely continuous around the sidewall of the lid.

In various embodiments, the lid is configured to snap-fit into the opening of the housing. Also, the projection extending from the lid can define at least one rib that mates with at least one channel made in the internal walls of the housing. Or, the internal walls of the housing can include at least one rib that mates with at least one channel made in the projection extending from the lid. The mating rib and channel also aid in creating a water resistant fuse holder.

The U-shape of the tab can be as severe or blunt as necessary to create a desired water resistant but removable fit between the lid and the housing. Also, the end of the tab can be balled or enlarged to further aid in creating a sealed interface between the lid and housing. In an embodiment, a second water resistant creating mechanism is provided. For example, a top surface of the housing can define a continuous ovular ridge that mates with a continuous ovular notch defined in an inner mating surface of the lid.

It is therefore an advantage of the present invention to provide an improved in-line fuse holder.

It is another advantage of the present invention to provide an improved water resistant fuse holder.

It is, a further advantage of the present invention to provide multiple embodiments for an in-line and/or water resistant fuse holder.

Moreover, it is an advantage of the present invention to provide in-line and/or water resistant fuse holders that are operable with different types of fuses, such as typical blade fuses, low profile blade fuses and cartridge fuses.

Additional features and advantages, of the present invention are described in, and will be apparent from, the following Detailed Description of the Invention and the figures.

DETAILED DESCRIPTION OF THE INVENTION

Figure 1:
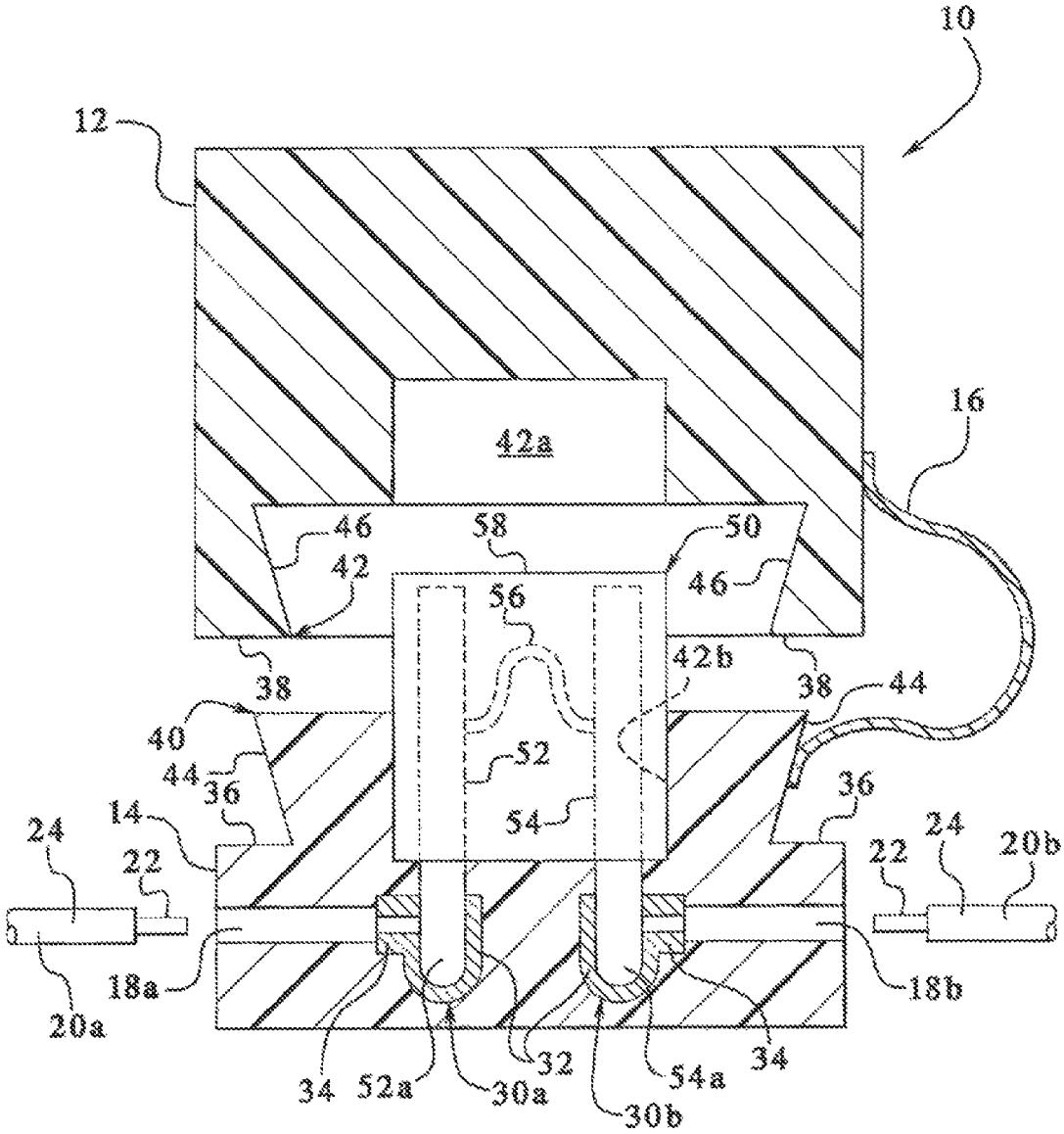
FIG. 1 is a sectioned elevation view of one embodiment of an in-line water resistant fuse holder.

Referring now to the drawings and in particular to FIG. 1, one example of an in-line and/or water resistant fuse holder is illustrated by fuse holder 10. Fuse holder 10 includes an upper housing 12 and a lower housing 14. Housings 12 and 14 are connected removably together by a strap 16. Housing 12, housing 14 and strap 16 may be made of any suitable one or more material, such as plastic, rubber, etc., or any combination thereof. Housing 12 may be made of the same or different material as is housing 14. In an embodiment, housings 12 and 14 are molded pieces, such as pieces made via injection molding, blow molding, etc., or any combination thereof. Housings 12 and 14 may be made as a single piece construction with strap 16. Alternatively, housings 12 and 14 are made separately, and strap 16 is formed integrally with one of the housings and (i) bonded, (ii) heat-sealed, (iii) sonically sealed or (iv) adhered to the other of the housings. Strap 16 is further alternatively fixed via any one of those processes to both housings 12 and 14.

Fuse holder 10 holds a fuse 50. Fuse 50 in FIG. 1 is illustrated as a typical automotive male-type blade fuse having terminals 52 and 54 connected electrically via a fuse element or fuse link 56. As is common with standard blade fuses, a portion of terminal 52, namely portion 52*a*, extends beneath a plastic or insulative housing 58. Likewise, a portion of terminal 54, namely portion 54*a*, extends beneath housing 58. Housing 58 covers the remaining portion of terminals 52 and 54 and all of fuse element or fuse link 56. Housing 58 aids in the placement of fuse 50 into either a fuse block of an automobile or, in this case, the fuse holder 10 of the present invention. Housing 58 also contains the energy released upon an opening of link or element 56. Fuse 50 may be sized for any known current rating. Housings 12 and 14 of fuse holder 10 may be scaled to hold any size fuse 50.

Lower housing 14 in the illustrated embodiment defines a pair of apertures or tubular lumens 18*a* and 18*b*. Tubular lumens 18*a* and 18*b* are sized to snugly receive leads or wires 20*a* and 20*b*. As illustrated, each lead or wire includes an exposed conductive end 22 and an insulated portion 24. Insulated portions 24 can seal to the walls of tubular lumens 18*a* and 18*b* in a water resistant manner.

Conductive ends 22 of leads 20*a* and 20*b* are inserted into a respective metallic or conductive element 30*a* and 30*b*. Metallic elements 30*a* and 30*b* are molded into housing 14. Elements 30*a* and 30*b* each include a plurality of crimping members 32 that are spaced apart to mechanically hold lower portions 52*a* and 54*a* of terminals 52 and 54 of fuse 50 when fuse 50 is inserted into lower housing 14. Crimping members 32 hold fuse 50 snugly in place but also enable fuse 50 to be removed if element or link 56 opens, due, for example, to an overcurrent condition, such as a short-circuit or circuit overload.

Elements 30*a* and 30*b* also include crimping sections 34 that are configured to connect to and hold fixed in electrical communication the conductive wire portion 22 of leads 20*a* and 20*b*. In one embodiment, once conductive ends of leads 20*a* and 20*b* are crimped into crimping sections 34 of elements 30*a* and 30*b*, leads 20*a* and 20*b* cannot thereafter be removed from lower housing 14. Alternatively, leads 20*a* and 20*b* are held removably within crimping sections 34 of elements 30*a* and 30*b*. Crimping members 32 and crimping sections 34 of elements 30*a* and 30*b* hold fuse terminals 52 and 54 and conductive ends 22 of the leads 20*a* and 20*b* via any suitable apparatus known to those of skill in the art, such as any automatic crimping or connecting device.

When leads 20*a* and 20*b* are crimped into crimping sections 34 of elements 30*a* and 30*b*, respectively, and fuse 50 is inserted into lower housing 14, lead 20*a* is forced into electrical communication with terminal 52 of fuse 50, while lead 20*b* is forced into electrical communication with terminal 54 of fuse 50.

Lower housing 14 includes an upper surface 36, while upper housing 12 includes a lower surface 38. As illustrated, a projection 40 extends upwardly from upper surface 36 of lower housing 14. A mating cavity 42 extends upwardly from lower surface 38 into upper housing 12. Cavity 42 includes an upper portion 42*a* defined in housing 12 and a lower portion 42*b* defined in lower housing 14. Lower portion 42*b* is filled, or at least substantially filled by fuse 50 in FIG. 1 and therefore is shown in phantom line. Upper cavity 42*a* fits over portion of fuse 50 extending out of lower housing 14 when upper housing 12 is mated with lower housing 14. Projection 40 includes a plurality of side walls 44, such as four side walls 44. At least some of the side walls 44 taper outwardly as projection 40 extends upwardly from surface 36 as shown in FIG. 1. Likewise, mating tapered or angled surfaces 46 of cavity 42 extend outwardly as cavity 42 extends upward to upper housing 12. Tapered surfaces 44 and 46 may have any suitable angle, such as ten to eighty degrees from vertical to provide a snug fit between housings 12 and 14, but which allow for a reasonable amount of force to close and open housings 12 and 14.

In the illustrated embodiment, projection 40 and cavity 42 include four tapered mating sides 44 and 46. In an alternative embodiment, one or more mating pair of tapered sides is provided to optimize ease of opening and closing with providing an at least somewhat watertight in-line fuse holder. In the illustrated embodiment, the surfaces of sides 44 and 46 are smooth or at least substantially smooth. In an alternative embodiment, sides 44 and 46 have mating serrations, notches, jagged edges, teeth, ribs or other configurations that either increase sealability or the ability to readily open and close housings 12 and 14.

While fuse holder 10 of FIG. 1 is illustrated housing a typical fuse 50, fuse holder 10, in an alternative embodiment, houses a different type of fuse, such as a low profile blade fuse or a female cartridge fuse. Also, while cavity 42 is shown split between upper and lower housings 12 and 14, in an alternative embodiment at least substantially all of cavity 42 and thus fuse 50 are provided in either one of housing 12 or housing 14. Further, while apertures or lumens 18*a* and 18*b* are shown being provided or defined solely by lower housing 14, lumens 18*a* and 18*b* are alternatively or additionally provided or defined by upper housing 12. Still further, fuse holder 10 may be configured to hold two or more fuses, for example, by stacking the apparatus shown in FIG. 1 behind one or more other such apparatuses within the holder 10.

Figure 2:
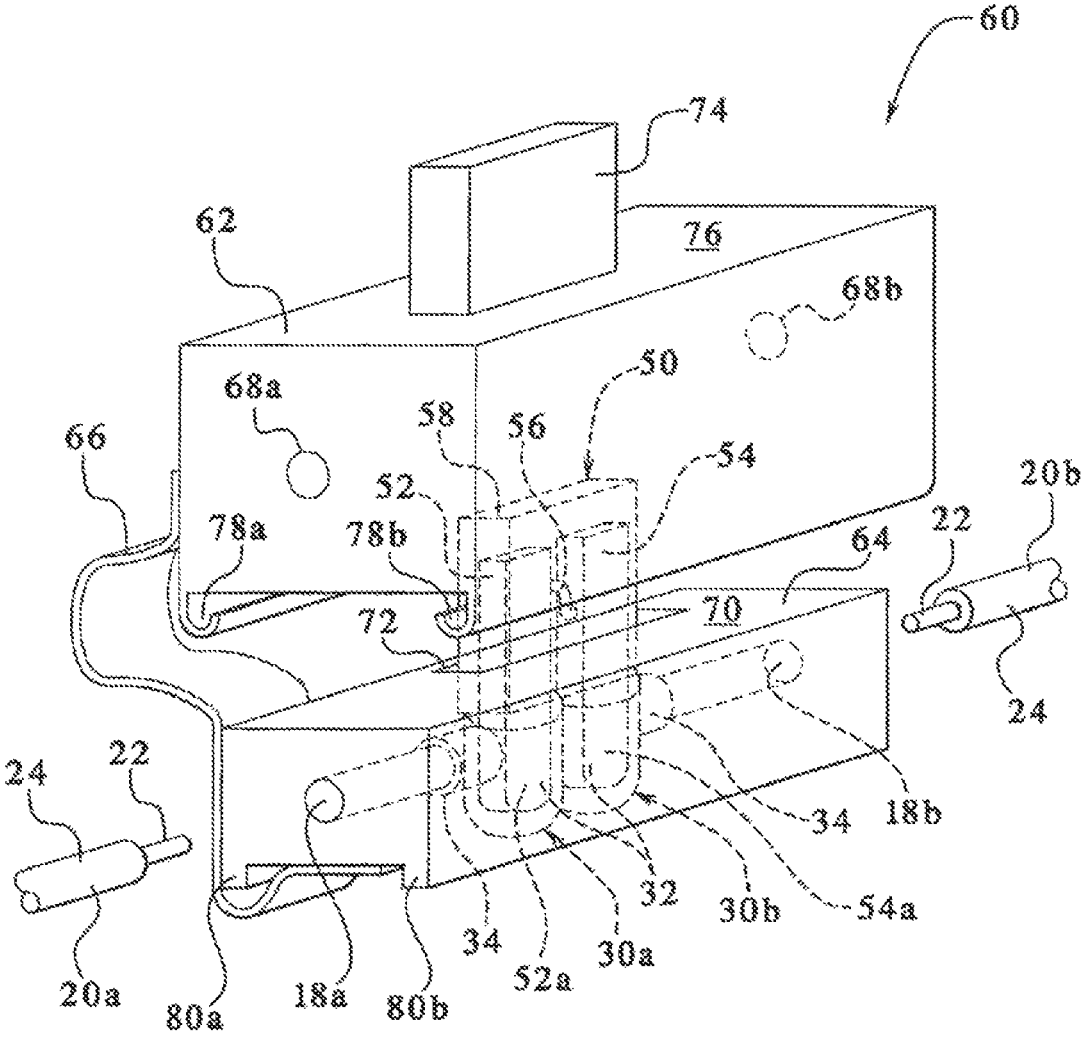
FIG. 2 is a schematic perspective view of another embodiment of an in-line water resistant fuse holder.

Referring now to FIG. 2, a second example of an in-line and/or water resistant fuse holder is illustrated by fuse holder 60. Fuse holder 60 includes many of the same apparatuses as described above for Fuse holder 10 of FIG. 1. Those apparatuses are numbered the same and operate the same as described above. In particular, lower housing 64 of fuse holder 60 defines a pair of apertures or tubular lumens 18*a* and 18*b*. Tubular lumens 18*a* and 18*b* are sized to snugly receive leads or wires 20*a* and 20*b*. Exposed conductive ends 22 of wires 20*a* and 20*b* are connected to crimping sections 34 of elements 30*a* and 30*b*, which are in turn embedded into housing 64. Insulated portions 24 of wires 20*a* and 20*b* seal to the walls of tubular lumens 18*a* and 18*b* in a water resistant manner.

Fuse holder 60 also holds a fuse 50 as described above. Here again, portion 52*a* of terminal 52 extends beneath a plastic or insulative housing 58. Likewise, portion 54*a* of terminal 54 extends beneath housing 58. Elements 30*a* and 30*b* include crimping members 32 described above, which are spread apart and biased thereafter to releasably hold lower portions 52*a* and 54*a* of terminals 52 and 54 of fuse 50 mechanically when fuse 50 is inserted into lower housing 64.

Fuse holder 60, like holder 10, includes an upper housing 62 and a lower housing 64. Housings 62 and 64 are connected removably together by a strap 66. Housing 62, housing 64 and strap 16 may be made of any suitable one or more material, such as plastic, rubber, such as plastic, rubber, etc., or any combination thereof. Housing 62 may be made of the same or different material as is housing 64. In an embodiment, housings 62 and 64 are molded pieces, such as pieces made via injection molding, blow molding or any combination thereof. Housings 62 and 64 may be made as a single piece construction with strap 66. Alternatively, housings 62 and 64 are made separately; and strap 66 is formed integrally with one of the housings and (i) bonded, (ii) heat-sealed, (iii) sonically sealed or (iv) adhered to the other of the housings. Strap 66 is further alternatively fixed via any one of those processes to both housings 62 and 64. As illustrated, strap 66 is fixed to the bottom of lower housing 64 so that upper housing 62 can be placed onto and removed from lower housing 64.

As described in more detail below, upper housing 62 fits over lower housing 64. Accordingly, upper housing defines or provides apertures 68*a* and 68*b* that align with tubular lumens 18*a* and 18*b*. Apertures 68*a* and 68*b* enable leads 20*a* and 20*b* to be inserted into tubular lumens 18*a* and 18*b*, respectively, and be coupled sealingly within fuse holder 60. Apertures 68*a* and 68*b* can have larger diameters than the diameters of tubular lumens 18*a* and 18*b* for clearance purposes and to allow a slight amount of misalignment between housings 62 and 64. Apertures 68*a* and 68*b* are alternatively slots that can extend through the bottom edges of the sides of upper housing 62 on which apertures 68*a* and 68*b* are made.

Lower housing 64 includes an upper surface 70, while upper housing 62 is generally a five sided structure which is open at the bottom. Upper and lower housings 62 and 64 are sized so that lower housing 64 fits snugly within upper housing 62. Upper surface 70 of lower housing 64 defines a cavity 72 that extends downwardly into housing 64. Cavity 72 is configured to be filled, or at least substantially filled, by the lower portion of fuse 50 in FIG. 2. The lower portion of fuse 50 fits snugly into cavity 72.

In the illustrated embodiment, an upper enclosure 74 projects upwardly from the top wall 76 of upper housing 62. Upper enclosure 74 defines a cavity that is configured to be filled, or at least substantially filled, by the upper portion of fuse 50. The upper portion of fuse 50 fits snugly into the cavity defined by upper enclosure 74.

As seen in FIG. 2, longitudinally extending hooks or snaps 78*a* and 78*b* extend from the bottom of the front and back sides of upper housing 62. In the illustrated embodiment two hooks or snaps 78*a* and 78*b* are provided. Alternatively, (i) only one side of upper housing 62 includes a hook or snap, (ii) three sides of upper housing 62 include hooks or snaps, or (iii) all four sides of upper housing 62 include hooks or snaps.

Hooks or snaps 78*a* and 78*b* are flexible and can spread apart as upper housing 62 is fitted over lower housing 64. When upper housing 62 is fitted onto lower housing 64, hooks or snaps 78*a* and 78*b* snap-fit onto ribs 80*a* and 80*b* projecting downwardly from the bottom edges of the front and back sides of lower housing 64. The snap-fitting of hooks or snaps 78*a* and 78*b* onto ribs 80*a* and 80*b* holds upper housing 62 onto lower housing 64 in a relatively permanent fashion. One is able to pull upper housing 62 off of lower housing 64 by first spreading apart hooks or snaps 78*a* and 78*b* if for example element 56 of fuse 50 opens, requiring fuse 50 to be replaced. Hooks or snaps 78*a* and 78*b* may run substantially continuously along the bottom of the sides of upper housing 62 or alternatively be spaced intermittently along those sides.

While fuse holder 60 of FIG. 2 is illustrated housing a typical type of blade fuse 50, fuse holder 60, in an alternative embodiment, houses a different type of fuse, such as a low profile blade fuse or a female cartridge fuse. Also, while FIG. 2 shows cavity 72 and upper enclosure 74, in an alternative embodiment, at least substantially all of fuse 50 is housed in lower housing 64. Further, while apertures or lumens 18*a* and 18*b* are shown being provided or defined solely by lower housing 64, lumens 18*a* and 18*b* are alternatively or additionally provided or defined by upper housing 62. Still further, fuse holder 60 may be configured to hold two or more fuses, for example, by stacking the apparatus shown in FIG. 2 behind one or more other such apparatuses within the holder 60.

Figure 3:
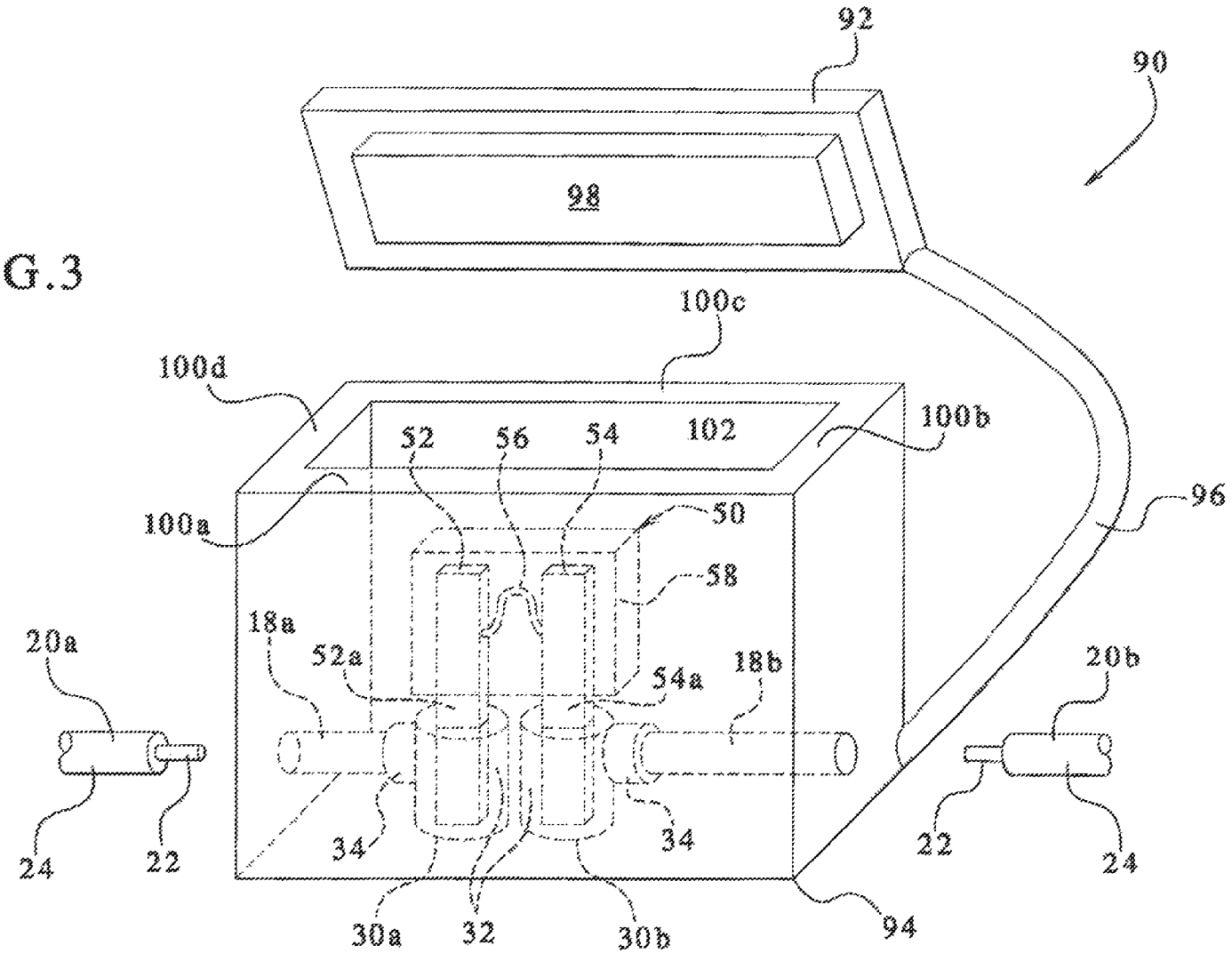
FIG. 3 is a schematic perspective view of a further embodiment of an in-line water resistant fuse holder.

Referring now to FIG. 3, a third example of an in-line and/or water resistant fuse holder is illustrated by fuse holder 90. Fuse holder 90 includes many of the same apparatuses as described above for fuse holders 10 and 60 of FIGS. 1 and 2. Those apparatuses are numbered the same and operate the same as described above. In particular, housing 94 of fuse holder 90 defines a pair of tubular lumens 18*a* and 18*b*. Tubular lumens 18*a* and 18*b* are sized to snugly receive leads or wires 20*a* and 20*b*. Exposed conductive ends 22 of wires 20*a* and 20*b* are connected to crimping sections 34 of elements 30*a* and 30*b*, which are in turn embedded into housing 94. Insulated portions 24 of wires 20*a* and 20*b* seal to the walls of tubular lumens 18*a* and 18*b* in a water resistant manner.

Fuse holder 90 also holds a fuse 50 as described above. Here again, portion 52*a* of terminal 52 extends beneath aplastic or insulative housing 58. Likewise, portion 54*a* of terminal 54 extends beneath housing 58. Elements 30*a* and 30*b* include crimping members 32 described above, which are spaced apart and biased thereafter to releasably hold lower portions 52*a* and 54*a* of terminals 52 and 54 of fuse 50 mechanically when fuse 50 is inserted into lower housing 94.

Fuse holder 90 includes a lid 92 and housing 94. Lid 92 and housing 94 are connected removably together by a strap 96. Lid 92, housing 94 and strap 96 may be made of any suitable one or more material described above. Lid 92 may be made of the same or different material as is housing 94. In an embodiment, lid 92 and housing 94 are molded pieces made via any of the processes described above. Lid 92 and housing 94 may be made as a single piece construction with strap 96. Alternatively, lid 92 and housing 94 are made separately, and strap 96 is formed integrally with one of the housings and (i) bonded, (ii) heat-sealed, (iii) sonically sealed or (iv) adhered to the other of the housings. Strap 96 is further alternatively fixed via any one of those processes to both lid 92 and housing 94. Lid 92 is yet further alternatively hinged to housing 94 via a suitable hinge (not illustrated).

Lid 92 includes or defines a projection 98. Projection 98 is illustrated having a generally rectangular block shape but alternatively has any suitable shape. Projection 98 is illustrated as being of a single piece but alternatively is made up of multiple pieces. In one preferred embodiment, projection 98 seals continuously to each edge 100*a* to 100*d* forming opening or cavity 102 in housing 94 to help provide a water resistant fuse holder 90. Projection 98 could for example be a continuous rib forming a rectangular ring that seals continuously to each edge 100*a* to 100*d* of housing 94. In that embodiment, projection 98 is in effect a permanent rectangular o-ring that helps to seal lid 92 to the edges 100*a* to 100*d* of housing 94. Projection 98 can further alternatively have laterally extending ribs (not shown) that engage mating laterally extending channels defined on the inner surfaces of sidewalls of housing 94, below edges 100*a* to 100*d*. The engagement of the ribs and channels helps to hold lid 92 to housing 94 in a water resistant relationship. Alternatively, the sidewalls of housing 94 define or provide inwardly and laterally extending ribs, while projection 98 defines mating laterally extending cavities.

In a further alternative embodiment (not illustrated), lid 92 is configured in a cap-like manner having small sidewalls that sealingly and/or snap-fittingly fit over edges 100*a* to 100*d* of housing 94. In any case, lid 92 is configured to removably and sealingly fit onto edges 100*a* to 100*d* of housing.

Opening or cavity 102 of housing 94 is sized and configured so that fuse 50 fits snugly within the opening 102 of housing 94. In the illustrated embodiment, fuse 50 fits entirely within opening or cavity 102, and lid 92 covers the top of fuse 50 when snap-fitted onto housing 94. Alternatively, a portion of fuse 50 resides above edges 100*a* to 100*d* after terminals 52 and 54 of fuse 50 are fitted into elements 30*a* and 30*b* of holder 90. In that case, lid 92 and projection 98 are formed and configured to fit over the top portion of fuse 50 that resides above edges 100*a* to 100*d*.

Figure 4:
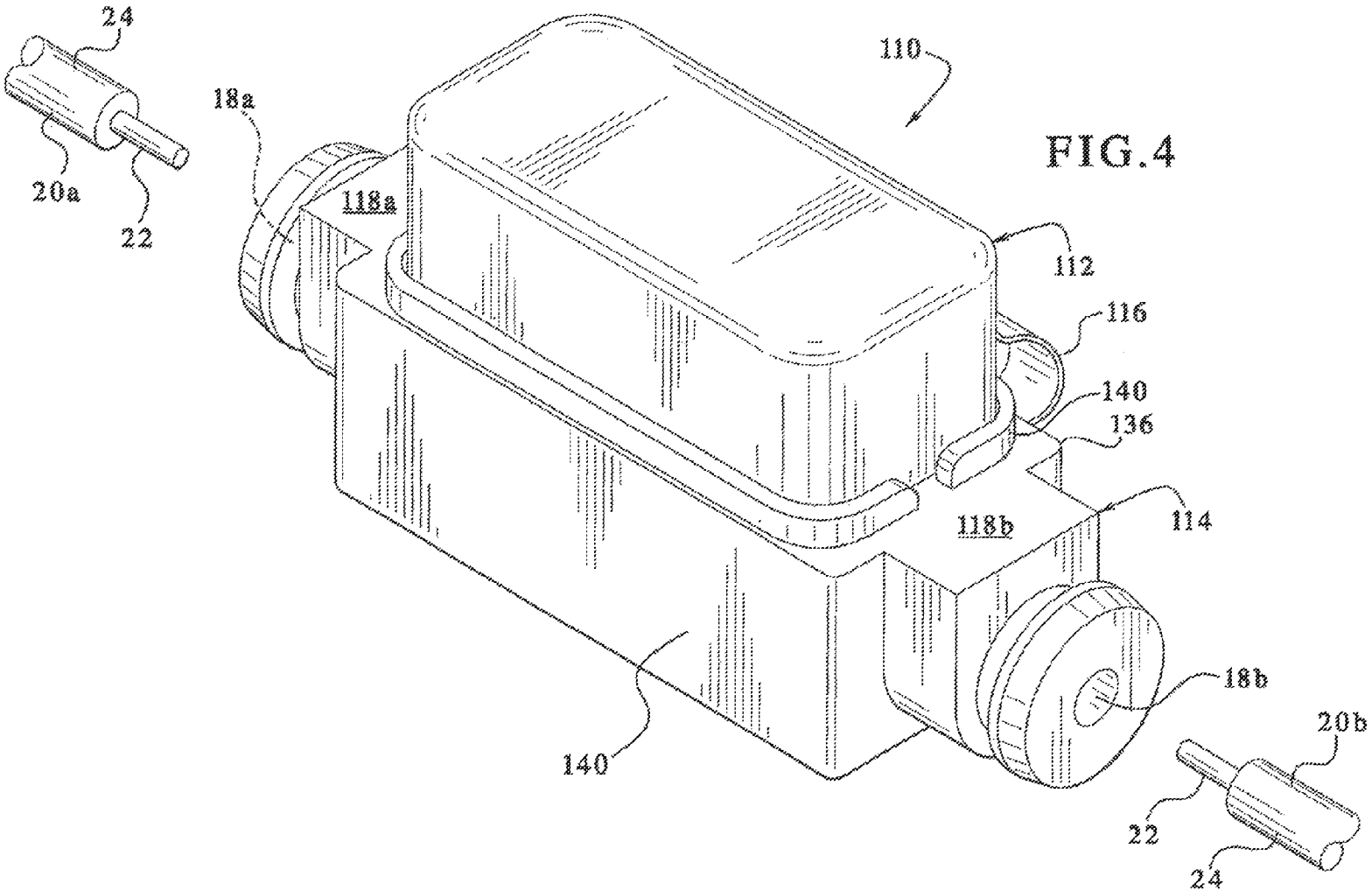
FIG. 4 is a perspective view of one embodiment of an in-line, water resistant fuse holder.

Fuse holder 90 may be configured to hold two or more fuses, for example, by stacking the apparatus shown in FIG. 3 behind one or more other such apparatuses within the holder 90. Also, while fuse holder 90 of FIG. 3 is illustrated housing a typical type of blade fuse 50, fuse holder 90 in an alternative embodiment, houses a different type of fuse, such as a low profile blade fuse or a female cartridge fuse. Embodiments of fuse holder configurations for holding a low profile blade fuse and a female cartridge fuse are shown below in FIGS. 4 and 5.

Referring now to FIGS. 4 to 8, one example of an in-line and/or water resistant fuse holder is illustrated by fuse holder 110. Fuse holder 110 includes a lid 112 and a housing 114. Lid 112 and housing 114 are connected removably together by a strap 116 in one embodiment. Alternatively lid 112 is maintained separately from housing 114.

Lid 112, housing 114 and strap 116 may be made of any suitable one or more material, such as plastic, rubber, etc., or any combination thereof. Lid 112 may be made of the same or different material as is housing 114. In an embodiment, lid 112 and housing 114 are molded pieces, such as pieces made via injection molding, blow molding, etc., or any combination thereof. Lid 112 and housing 114 may be made as a single piece construction with strap 116. Alternatively, lid 112 and housing 114 are made separately, and strap 116 is formed integrally with one of the housings and (i) bonded, (ii) heat-sealed, (iii) sonically sealed or (iv) adhered to the other of the housings. Strap 116 is further alternatively fixed via any one of those processes to both lid 112 and housing 114.

Housing 114 in the illustrated embodiment includes wire holder portions 118*a* and 118*b*, each of which defines an aperture or tubular lumen 18*a* and 18*b*, respectively. Tubular lumens 18*a* and 18*b* are sized to snugly receive leads or wires 20*a* and 20*b*. As illustrated, each lead or wire includes an exposed conductive end 22 and an insulated portion 24. The walls of wire holder portions 118*a* and 118*b* forming tubular lumens 18*a* and 18*b* are sized to hold wires 20*a* and 20*b* in a water resistant manner. Conductive ends 22 of leads 20*a* and 20*b* are inserted into the respective metallic or conductive elements 30*a* and 30*b* via wire holder portions 118*a* and 118*b*.

Figure 5:
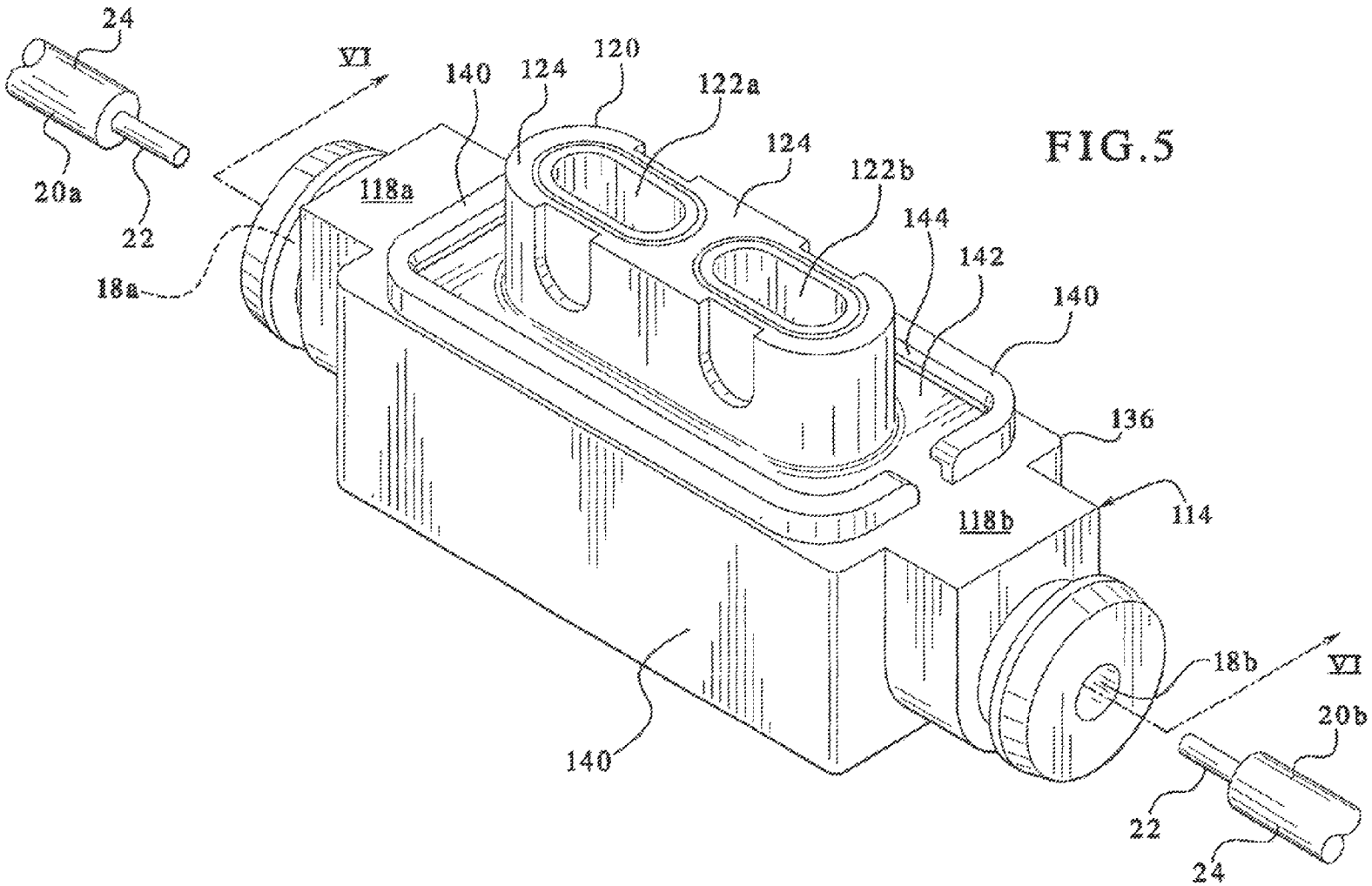
FIG. 5 is a perspective view of a housing portion of the in-line, water resistant fuse holder of FIG. 4.
Figure 6:
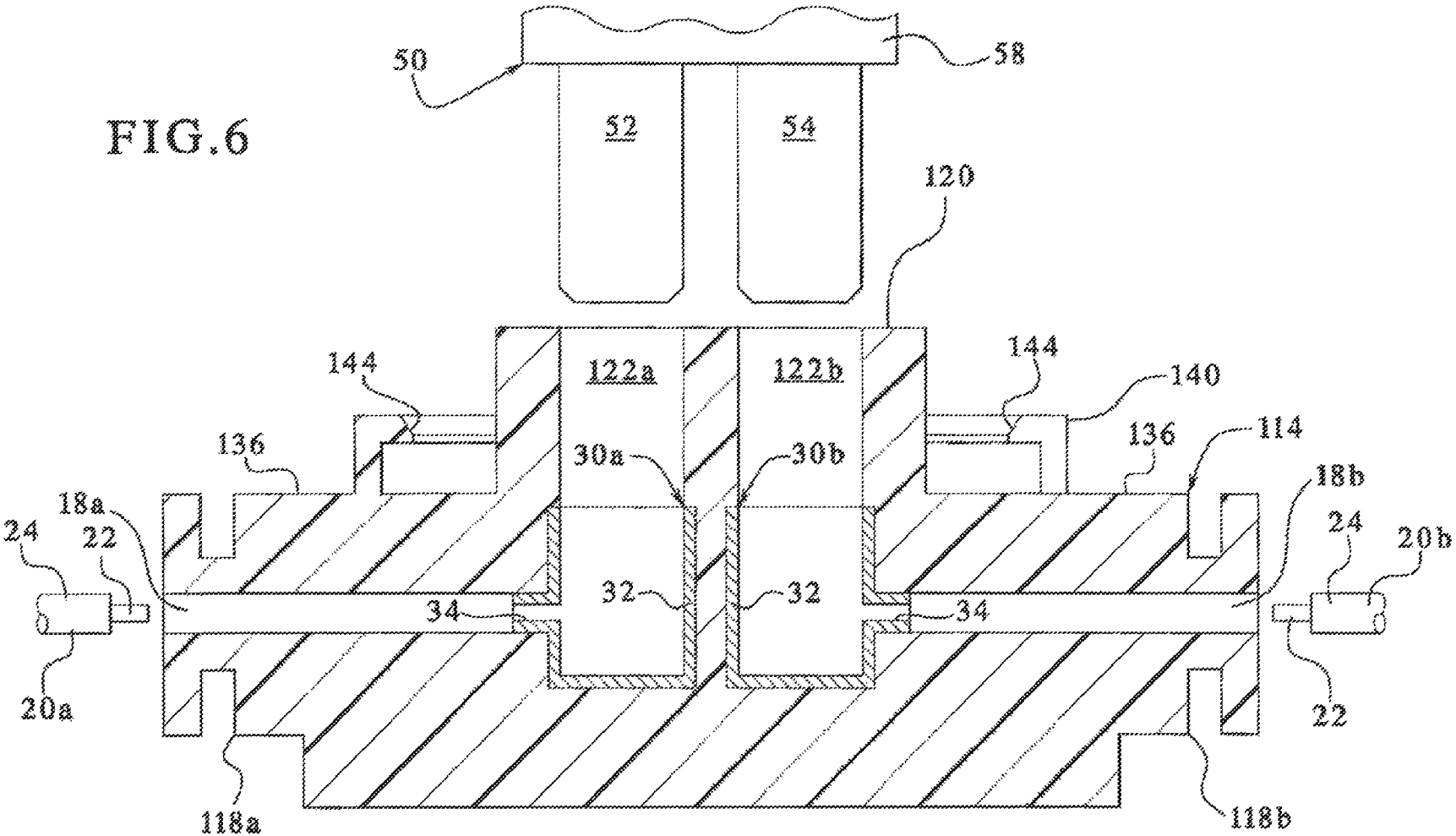
FIG. 6 is a sectioned elevation view of the housing of FIG. 5 taken along line VI-VI of FIG. 5.

As seen in FIGS. 5 and 6, a fuse holder 110 is configured to hold a fuse 50 as described above. Here again, portion 52*a* of terminal 52 extends into element 30*a*, while portion 54*a* of terminal 54 extends into element 30*b* via a fuse insertion portion 120, which extends from an upper surface 136 of housing 114. Insertion portion 120 includes or defines terminal acceptors 122*a* and 122*b*, which accept terminals 52 and 54, respectively, and guide same towards conductive elements 30*a* and 30*b*, respectively, molded into and held within housing 114. Insertion portion 120 also includes locking indents 124, which accept mating inwardly extending locking projections 126 of lid 112 shown in FIG. 7. Locking indents 124 and locking projections 126 help to hold lid 112 removably to housing 114.

As above, elements 30*a* and 30*b* each include a plurality of crimping members 32 that are spaced apart to mechanically hold terminals 52 and 54 of fuse 50 when fuse 50 is inserted into lower housing 14. Crimping members 32 hold fuse 50 snugly in place but also enable fuse 50 to be removed if element or link 56 of fuse 50 opens, due, for example, to an overcurrent condition, such as a short-circuit or circuit overload.

Elements 30*a* and 30*b* also include crimping sections 34 that are configured to connect to and hold fixed in electrical communication the conductive wire portion 22 of leads 20*a* and 20*b*. In one embodiment, once conductive ends of leads 20*a* and 20*b* are crimped into crimping sections 34 of elements 30*a* and 30*b*, leads 20*a* and 20*b* cannot thereafter be removed from housing 114. Alternatively, leads 20*a* and 20*b* are held removably within crimping sections 34 of elements 30*a* and 30*b*. Crimping members 32 and crimping sections 34 of elements 30*a* and 30*b* hold fuse terminals 52 and 54 and conductive ends 22 of the leads 20*a* and 20*b* via any suitable apparatus known to those of skill in the art, such as any automatic crimping or connecting device.

When leads 20*a* and 20*b* are crimped into crimping sections 34 of elements 30*a* and 30*b*, respectively, and fuse 50 is inserted into housing 114, lead 20*a* is forced into electrical communication with terminal 52 of fuse 50, while lead 20*b* is forced into electrical communication with terminal 54 of fuse 50.

Lid 112 includes a lower edge 138, which engages the upper surface 136 of housing in an at least substantially water tight manner described below. As illustrated, a rim 140 extends upwardly from upper surface 136 of housing 114. Rim 140 as illustrated is continuous and almost forms a complete ring around insertion portion 120 of housing 114. A gap 142 is formed in rim 140, for example, to allow one's finger or tool, e.g., a flat-head screw driver easier access to remove lid 112 from housing 114 when needed. In an alternative embodiment, rim 140 forms a complete ring around insertion portion 120 of housing 114. In such case, lid 112 can be provided with indentations or other features facilitating the popping or removing of lid 112 from housing 114.

Figure 8:
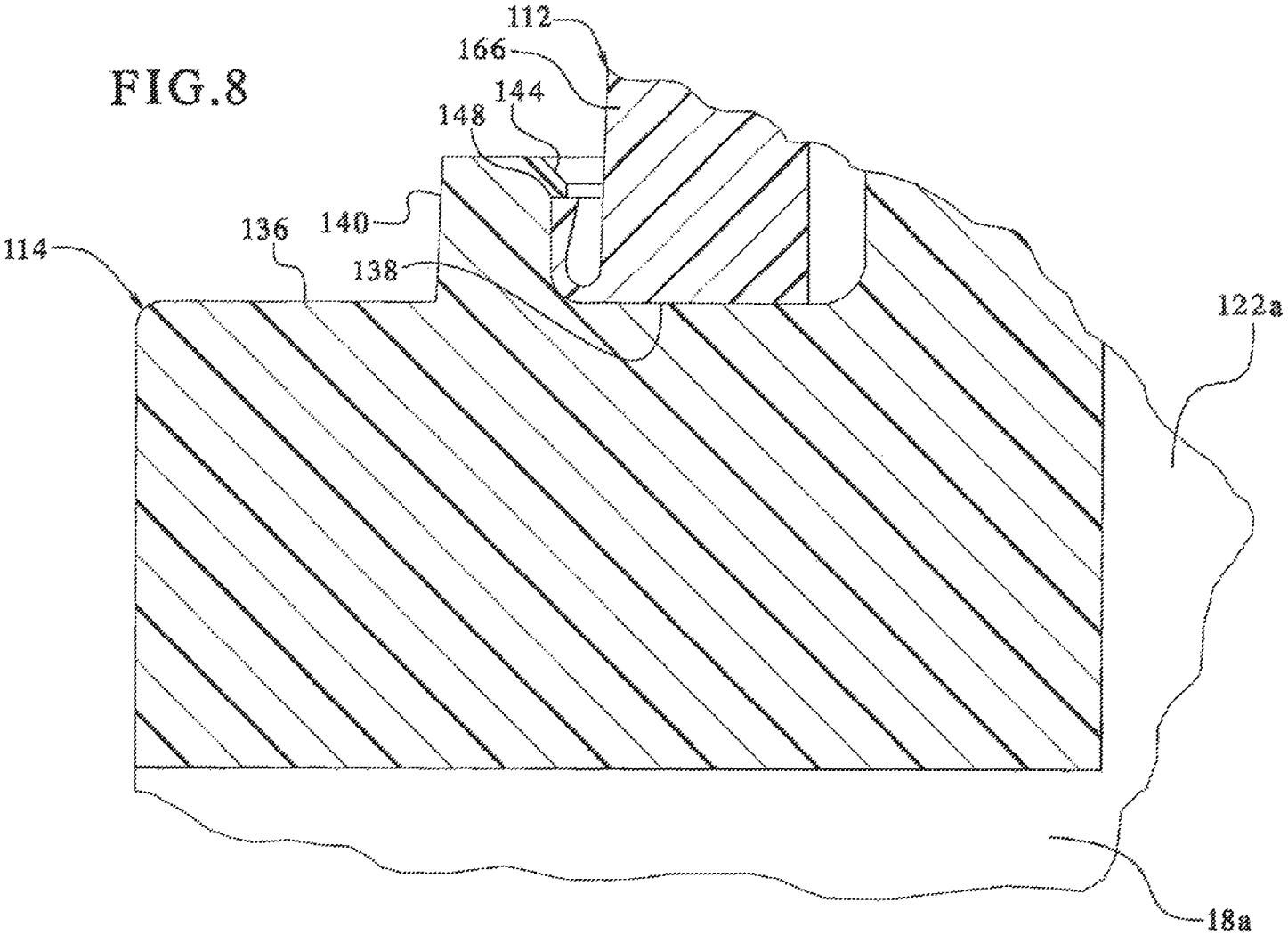
FIG. 8 is a sectioned, fragmentary view of a portion of the lid showing the locking tab of FIG. 7 engaging a rim and associated inwardly projecting lip of the housing, wherein the lid is coupled removably to the housing in an at least substantially water resistant manner.

As seen in FIGS. 5, 6 and 8, a lip 144 extends inwardly from the top of rim 140 of housing 114. Lip 144 as seen can be chamfered to allow for flexibility. In an embodiment, lip 144 is continuous along the upper, inner surface of rim 140. Rim 140 can alternatively have any suitable cross-sectional shape.

FIG. 8 also shows that terminal acceptor 122*a* communicates with lumen 18*a*, wherein lumen 18*a* enables lead 20*a* to be inserted within housing 114, so that conductive end 22 of lead 20*a* can communicate with crimping section 34 of element 30*a* (not seen in FIG. 8) provided within housing 114.

Figure 7:
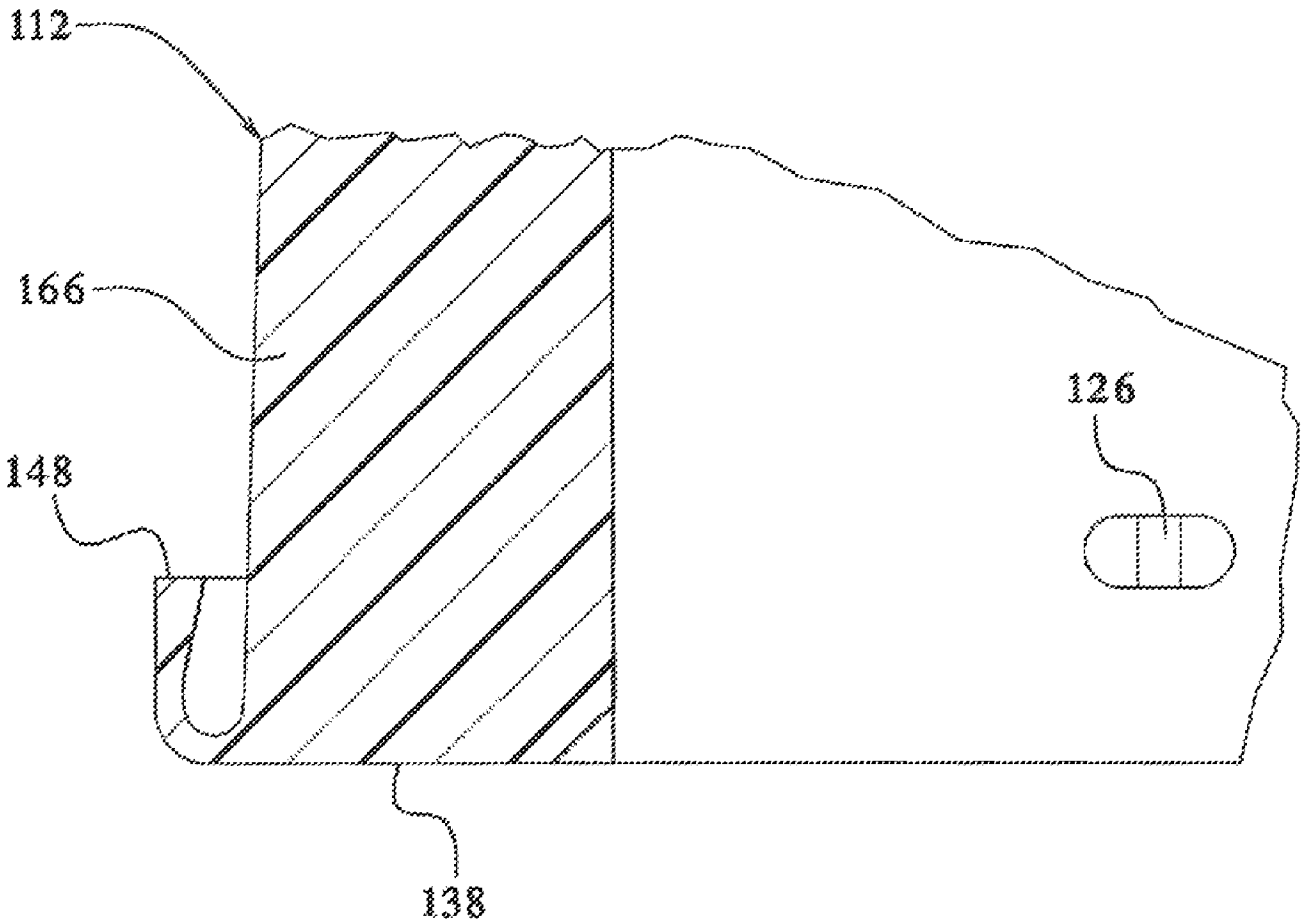
FIG. 7 is a sectioned, fragmentary view of a portion of the lid of the in-line, water resistant fuse holder of FIG. 4 showing an outwardly projecting locking tab configured such that the lid can be coupled removably to the housing in an at least substantially water resistant manner.

As seen in FIG. 7, lid 112 includes or defines an outwardly extending tab 148. Tab 148 in an embodiment extends continuously outwardly along the entire at least one sidewall 166 of lid 112. Outwardly extending tab 148 in combination with the sidewall 166 of lid 112 forms a U-shape. The U-shape provides flexibility along with the chamfered surface of lip 144 of rim 140 for the ready insertion and removal of lid 112 onto housing 114. Tab 148 can alternatively have any suitable cross-sectional shape, such as a T-shape, C-shape, O-ring shape or V-shape.

FIG. 8 shows tab 148 of lid 112 engaged in a removably locked relationship with lip 144 and rim 140 of housing 114. The U-shape formed by tab 148 allows tab 148 to flex rotatably about the base of the U-shape. Such flexing allows lid 112 to be inserted onto housing 114, such that tab 148 snaps beneath lip 144 and locks into rim 140, so that the resulting interface is at least substantially water resistant. The flexing also allows lid 112 to be removed from housing 114 without too much difficulty, for example, after fuse 50 has opened and needs to be replaced.

While fuse holder 110 of FIGS. 4 to 8 is illustrated housing a male-type blade fuse 50, fuse holder 110, in an alternative embodiment, houses a different type of fuse, such as a low profile blade fuse or a female cartridge fuse. Also, while apertures or lumens 18*a* and 18*b* are shown being provided or defined solely by housing 114, lumens 18*a* and 18*b* are alternatively or additionally provided or defined by lid 112. Still further, fuse holder 110 may be configured to hold two or more fuses, for example, by stacking the apparatus shown in FIGS. 4 to 8 behind one or more other such apparatuses within the holder 110.

Figure 9:
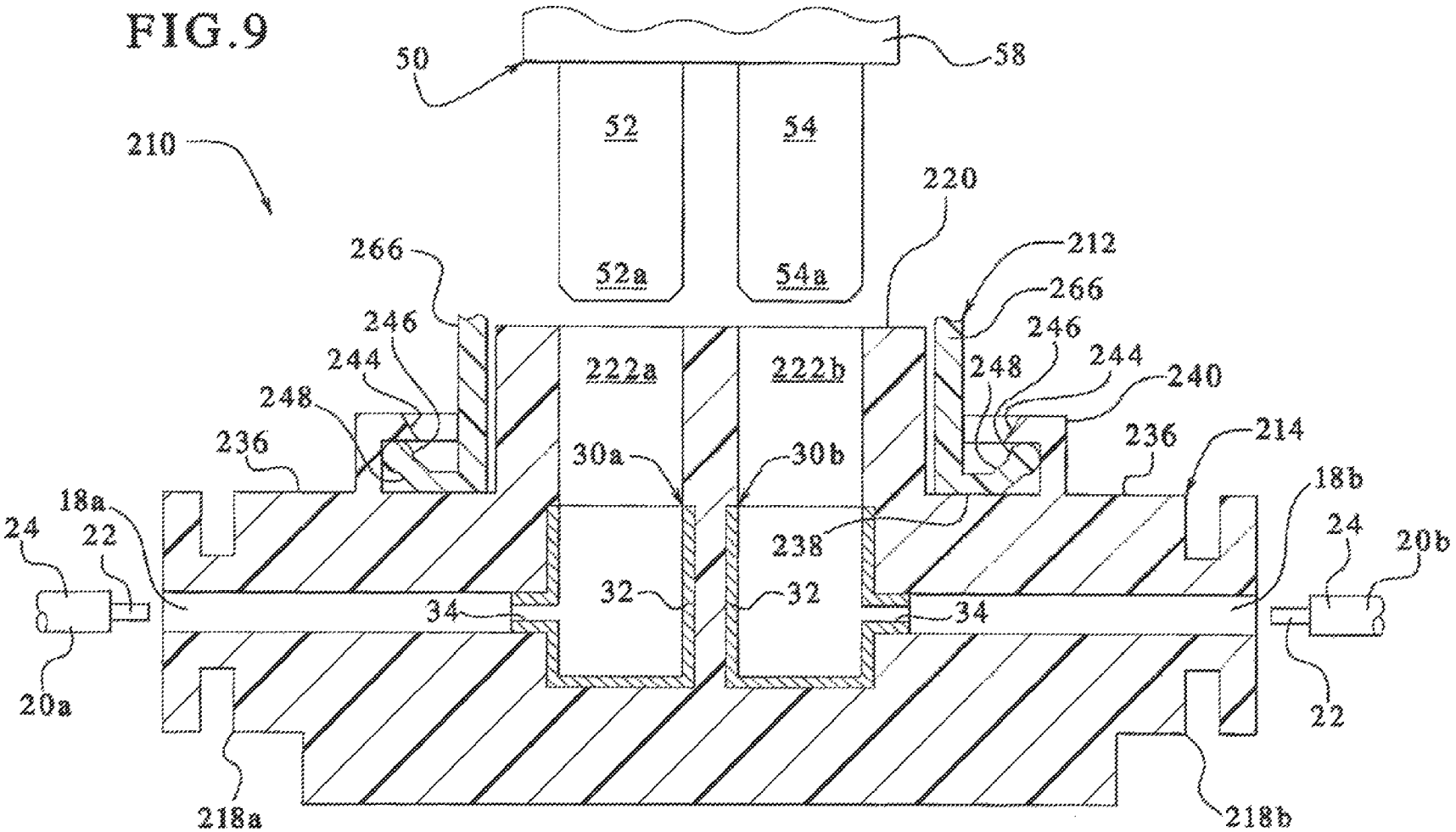
FIG. 9 is a sectioned view of an alternative housing and cap arrangement for an in-line, water resistant fuse holder.

Referring now to FIG. 9, another example of an in-line and/or water resistant fuse holder is illustrated by fuse holder 210. Fuse holder 210 includes a lid 212 (shown partially) and a housing 214. Lid 212 and housing 214 are connected removably together by a strap (not illustrated) in one embodiment. Alternatively lid 212 is maintained separately from housing 214.

Lid 212, housing 214 and the strap may be made of any suitable one or more material, such as plastic, rubber, etc., or any combination thereof. Lid 212 may be made of the same or different material as is housing 214. In an embodiment, lid 212 and housing 214 are molded pieces, such as pieces made via injection molding, blow molding, etc., or any combination thereof. Lid 212 and housing 214 may be made as a single piece construction with the strap. Alternatively, lid 212 and housing 214 are made separately, and the strap is formed integrally with one of the housings and (i) bonded, (ii) heat-sealed, (iii) sonically sealed or (iv) adhered to the other of the housings. The strap is further alternatively fixed via any one of those processes to both lid 212 and housing 214.

Housing 214 in the illustrated embodiment includes wire holder portions 218*a* and 218*b*, each of which defines an aperture or tubular lumen 18*a* and 18*b*, respectively. Tubular lumens 18*a* and 18*b* are sized to snugly receive leads or wires 20*a* and 20*b* as discussed above. Conductive ends 22 of leads 20*a* and 20*b* are inserted into respective metallic or conductive elements 30*a* and 30*b* via wire holder portions 218*a* and 218*b*.

Fuse holder 210 also holds a fuse 50 as described above. Here again, portion 52*a* of terminal 52 extends into element 30*a*, while portion 54*a* of terminal 54 extends into element 30*b* via a fuse insertion portion 220, which extends from an upper surface 236 of housing 214. Insertion portion 220 includes terminal acceptors 222*a* and 222*b*, which accept terminals 52 and 54, respectively, and guide same towards conductive elements 30*a* and 30*b*, respectively, molded into housing 214. Insertion portion 220 can also include locking indents (not illustrated but similar to indents 124 of housing 114), which accept mating inwardly extending locking projections (not illustrated but similar to projections 126 of lid 112) of lid 212. The locking indents and locking projections help to hold lid 212 removably to housing 214.

As above, elements 30*a* and 30*b* each include a plurality of crimping members 32 that are spaced apart to mechanically hold lower portions 52*a* and 54*a* of terminals 52 and 54 of fuse 50 when fuse 50 is inserted into lower housing 214. Crimping members 32 hold fuse 50 snugly in place but also enable fuse 50 to be removed if element or link 56 of fuse 50 opens, due, for example, to an overcurrent condition, such as a short-circuit or circuit overload.

Elements 30*a* and 30*b* also include crimping sections 34 that are configured to connect to and hold fixed in electrical communication the conductive wire portion 22 of leads 20*a* and 20*b*. In one embodiment, once conductive ends of leads 20*a* and 20*b* are crimped into crimping sections 34 of elements 30*a* and 30*b*, leads 20*a* and 20*b* cannot thereafter be removed from housing 214. Alternatively, leads 20*a* and 20*b* are held removably within crimping sections 34 of elements 30*a* and 30*b*. Crimping members 32 and crimping sections 34 of elements 30*a* and 30*b* hold fuse terminals 52 and 54 and conductive ends 22 of the leads 20*a* and 20*b* via any suitable apparatus known to those of skill in the art, such as any automatic crimping or connecting device.

When leads 20*a* and 20*b* are crimped into crimping sections 34 of elements 30*a* and 30*b*, respectively, and fuse 50 is inserted into housing 214, lead 20*a* is forced into electrical communication with terminal 52 of fuse 50, while lead 20*b* is forced into electrical communication with terminal 54 of fuse 50.

Lid 212 includes a lower edge 238, which engages the upper surface 236 of housing in an at least substantially water tight manner described below. As illustrated, a rim 240 extends upwardly from upper surface 236 of housing 214. Rim 240 can be continuous or almost continuous (e.g., include a gap such as gap 142 of housing 114) around insertion portion 220 of housing 214.

A lip 244 extends inwardly from rim 240 of housing 214. Lip 244 as seen can be chamfered to allow for flexibility. In an embodiment, lip 244 is continuous along the upper, inner surface of rim 240. Rim 240 can alternatively have any suitable cross-sectional shape.

FIG. 9 shows an alternative tab 248 of lid 212 engaged in a removably locked relationship with lip 244 and rim 240 of housing 214. Here, the U-shape formed by tab 248 is shallower or blunter than the more extreme U-shape of tab 148 of lid 112. Also, tab 248 has a balled or enlarged end 246. The blunter angle of tab 248 slides along the chamfer of lip 244 as lid 212 is placed on housing 214. Balled end 246 eventually snap-fits in an at least substantially water resistant relationship with lip 244. The balled or enlarged end 246 of tab 248 helps to maintain an at least substantially water resistant interface between lid 212 and housing 214. Lid 212 and tab 248 are also flexible enough so that lid 212 may be removed without too much difficulty from housing 214 after fuse 50 experiences an event causing it to open for example. Tab 248 can alternatively have any suitable cross-sectional shape, such as a T-shape, C-shape, O-ring shape or V-shape.

While fuse holder 210 of FIG. 9 is illustrated housing a male-type blade fuse 50, fuse holder 210, in an alternative embodiment, houses a different type of fuse, such as a low profile blade fuse or a female cartridge fuse. Also, while apertures or lumens 18*a* and 18*b* are shown being provided or defined solely by housing 214, lumens 18*a* and 18*b* are alternatively or additionally provided or defined by lid 212. Still further, fuse holder 210 may be configured to hold two or more fuses, for example, by stacking the apparatus shown in FIG. 9 behind one or more other such apparatuses within the holder 210.

Referring now to FIGS. 10 to 13, another example of an in-line and/or water resistant fuse holder is illustrated by fuse holder 310. Fuse holder 310 includes a lid 312 and a housing 314. Lid 312 and housing 314 are connected removably together by a strap (not illustrated) in one embodiment. Alternatively lid 312 is maintained separately from housing 314.

Lid 312, housing 314 and the strap may be made of any suitable one or more material, such as plastic, rubber, etc., or any combination thereof. Lid 312 may be made of the same or different material as is housing 314. In an embodiment, lid 312 and housing 314 are molded pieces, such as pieces made via injection molding, blow molding, etc., or any combination thereof. Lid 312 and housing 314 may be made as a single piece construction with the strap. Alternatively, lid 312 and housing 314 are made separately, and the strap is formed integrally with one of the housings and (i) bonded, (ii) heat-sealed, (iii) sonically sealed or (iv) adhered to the other of the housings. The strap is further alternatively fixed via any one of those processes to both lid 312 and housing 314.

Housing 314 in the illustrated embodiment includes wire holder portions 318*a* and 318*b*, each of which defines an aperture or tubular lumen 18*a* and 18*b*, respectively. Tubular lumens 18*a* and 18*b* are sized to snugly receive leads or wires 20*a* and 20*b* as discussed above. Conductive ends 22 of leads 20*a* and 20*b* are inserted into respective metallic or conductive elements 30*a* and 30*b* via wire holder portions 318*a* and 318*b*.

Fuse holder 310 also holds a fuse 50 (illustrated above) as described above. Here again, a portion of the terminals of fuse 50 extends into elements 30*a* and 30*b* via a fuse insertion portion 320, which extends from an upper surface 336 of housing 314. Insertion portion 320 here includes a single terminal acceptor 322, which accepts terminals 52 and 54 and guides same towards conductive elements 30*a* and 30*b*, respectively, molded into and held by housing 314.

Figure 10:
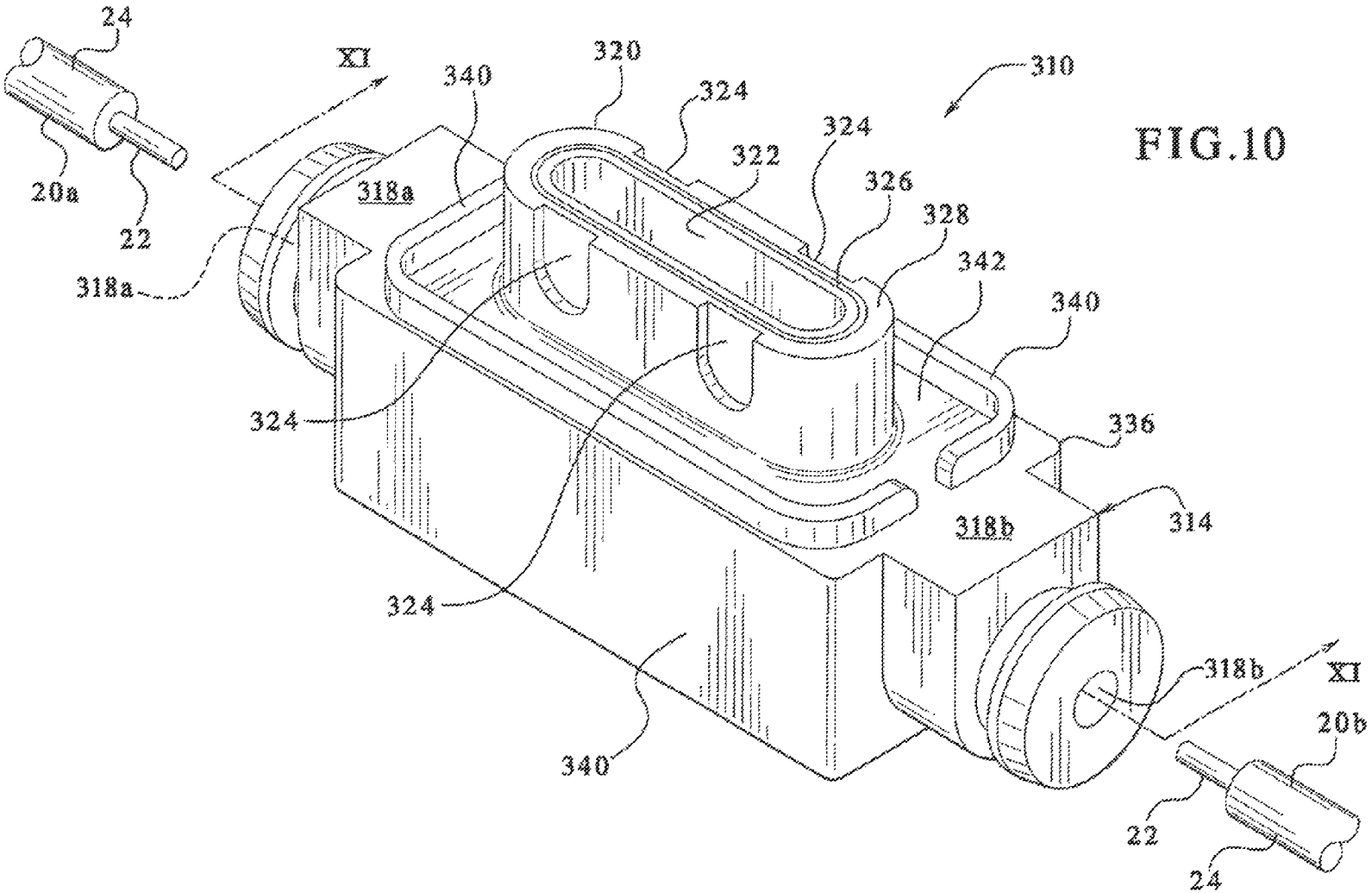
FIG. 10 is a perspective view of a housing portion of a further alternative in-line, water resistant fuse holder.
Figure 12:
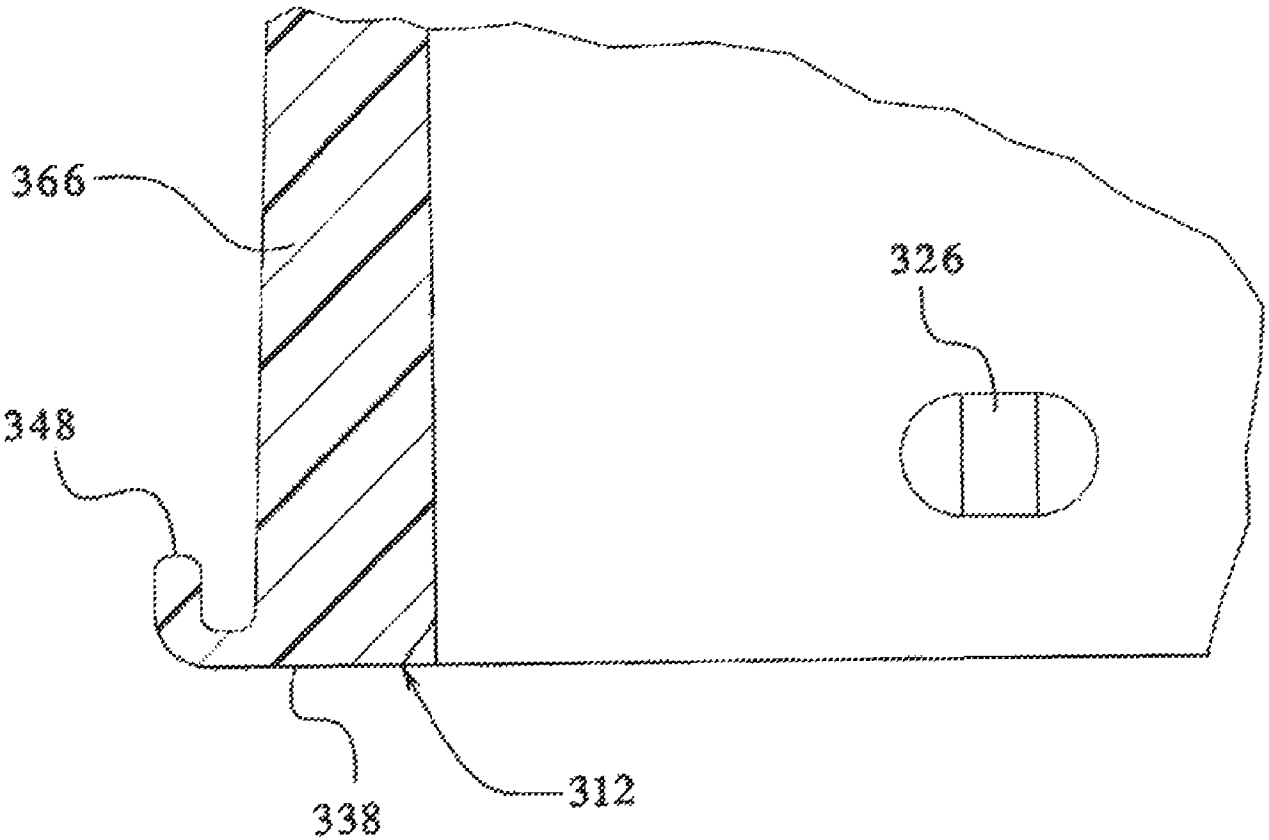
FIG. 12 is a sectioned, fragmentary view of a portion of the lid of the in-line, water resistant fuse holder of FIG. 11, showing an outwardly projecting locking tab configured such that the lid can be coupled removably to the housing in an at least substantially water resistant manner.

As seen in FIGS. 10 and 12, insertion portion 320 in an embodiment includes locking indents 324, which accept mating inwardly extending locking projections 326 of lid 312. The locking indents 324 and locking projections 326 help to hold lid 312 removably to housing 314.

As above, elements 30*a* and 30*b* each include a plurality of crimping members 32 that are spaced apart to mechanically hold the terminals of fuse 50 when fuse 50 is inserted into lower housing 314. Crimping members 32 hold fuse 50 snugly in place but also enable fuse 50 to be removed if element or link of fuse 50 opens, due, for example, to an overcurrent condition, such as a short-circuit or circuit overload.

Elements 30*a* and 30*b* also include crimping sections 34 that are configured to connect to and hold fixed in electrical communication the conductive wire portion 22 of leads 20*a* and 20*b*. In one embodiment, once conductive ends of leads 20*a* and 20*b* are crimped into crimping sections 34 of elements 30*a* and 30*b*, leads 20*a* and 20*b* cannot thereafter be removed from housing 314. Alternatively, leads 20*a* and 20*b* are held removably within crimping sections 34 of elements 30*a* and 30*b*. Crimping members 32 and crimping sections 34 of elements 30*a* and 30*b* hold fuse terminals of fuse 50 and conductive ends 22 of the leads 20*a* and 20*b* via any suitable apparatus known to those of skill in the art, such as any automatic crimping or connecting device.

When leads 20*a* and 20*b* are crimped into crimping sections 34 of elements 30*a* and 30*b*, respectively, and fuse 50 is inserted into housing 214, lead 20*a* is forced into electrical communication with terminal 52 (illustrated above) of fuse 50, while lead 20*b* is forced into electrical communication with terminal 54 (illustrated above) of fuse 50.

Lid 312 includes a lower edge 338, which engages the upper surface 336 of housing in an at least substantially water tight manner described below. As illustrated, a rim 340 extends upwardly from upper surface 336 of housing 314. Rim 240 can be continuous or almost continuous (e.g., include a gap such as gap 342) around insertion portion 320 of housing 314.

Figure 11:
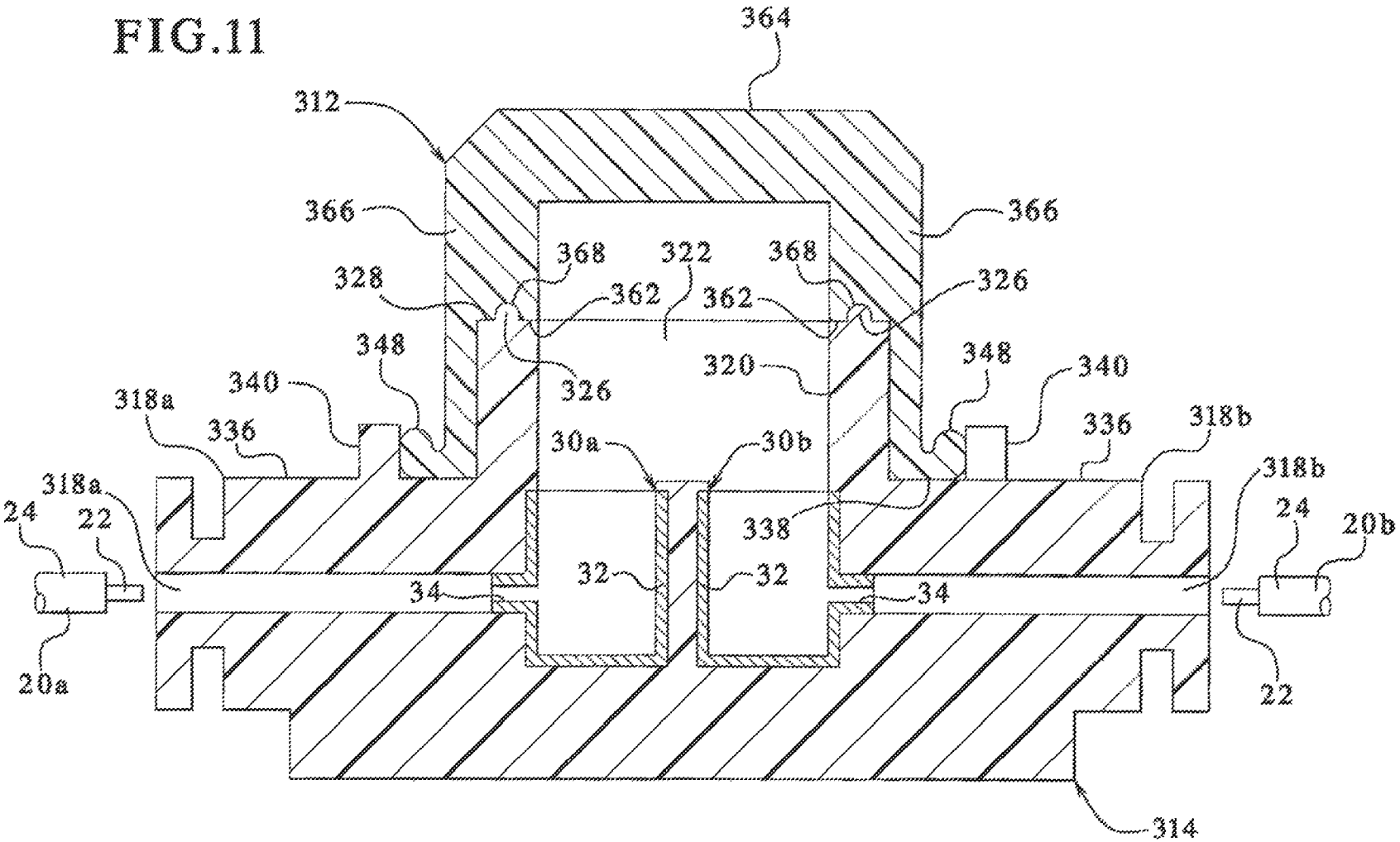
FIG. 11 is a sectioned elevation view of the housing of FIG. 10 taken along line XI-XI of FIG. 10, showing a sectioned lid connected removably to the housing.
Figure 13:
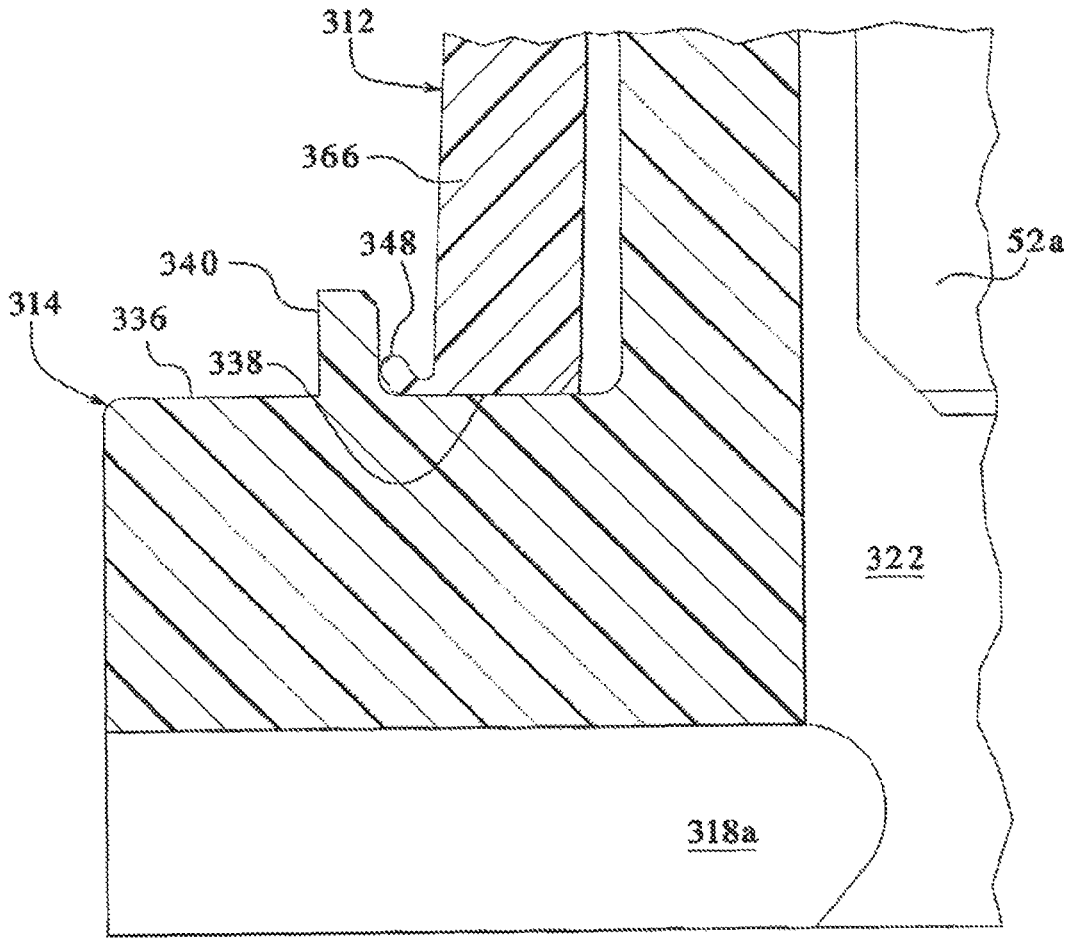
FIG. 13 is a sectioned, fragmentary view of a portion of the lid of FIGS. 11 and 12 coupled removably to the housing of FIGS. 10 and 11 in an at least substantially water resistant manner.

As seen in FIGS. 10, 11 and 13, rim 240 is at least substantially smooth along its inner and outer surfaces and does not have a corresponding snap-fit causing lip (such as lip 244 of rim 240 of housing 214). Rim 340 can alternatively have any suitable cross-sectional shape.

FIGS. 11, 12 and 13 show an alternative tab 348 of lid 312. FIG. 12 shows a closer view of tab 348 of lid 312, which as illustrated is outwardly extending. Tab 348 in an embodiment extends continuously outwardly along the entire lower end 338 of at least one sidewall 366 of lid 312. Outwardly extending tab 348 in combination with the sidewall 366 of lid 312 forms a U-shape that is blunter than the tab 148 described above. Tab 348 can alternatively have any suitable cross-sectional shape, such as a T-shape, C-shape, O-ring shape or V-shape.

FIGS. 11 and 13 sow tab 348 engaged in a removably locked relationship with rim 340 of housing 314. Here, the U-shape formed by tab 348 is again slightly shallower or blunter than the more extreme U-shape of tab 148 of lid 112. Tab 348 can also have a balled or enlarged end, similar to end 246 of tab 248. The blunter angle of tab 348 slides along the inner surface of rim 340 as lid 312 is placed on housing 314. Lid 312 can be slightly oversized relative to the opening defined by the inner surface of rim 340, causing a slight press-fit when lid 312 and tab 348 are forced into the opening defined by rim 340. Lid 312 and tab 348 are also flexible enough so that lid 312 may be removed without too much difficulty from housing 314 after fuse 50 experiences an event causing it to open for example.

FIG. 13 shows a closer view of tab 348 of lid 312 engaged in a removably locked relationship with rim 340 of housing 314. The U-shape formed by tab 348 allows tab 348 to flex rotatably about the base of the U-shape. Such flexing also allows lid 312 to be inserted onto housing 314, such that tab 348 press-fits against the inner surface of rim 340, so that the resulting interface is at least substantially water resistant. The flexing also allows lid 312 to be removed from housing 314 without too much difficulty, for example, after fuse 50 has opened and needs to be replaced.

FIG. 13 also shows that terminal acceptor 322 communicates with a lumen 318*a*, wherein lumen 318*a* enables lead 20*a* to be inserted within housing 314, so that conductive end 22 of lead 20*a* can communicate with crimping section 34 of element 30*a* (not seen in FIG. 13) provided within housing 314. Fig. also shows lower end 52*a* of terminal 52 of fuse 50 inserted into terminal acceptor 322 of housing 314.

FIGS. 10 and 11 illustrate a second interference or at least substantially water resistant causing mechanism between lid 312 and housing 314. Here, a semi-circular or U-shaped (in cross-section) upwardly projecting ridge 326 is formed, e.g., integrally, along an upper surface 328 of fuse insertion portion 320 of housing 314. Ridge 326 as illustrated forms a continuous, e.g., ovular, projection on the upper surface 328 of insertion portion 320.

FIG. 11 illustrates that an internal mating surface 362 of lid 312 defines an annular inwardly extending notch 368, which is configured to, conform to the shape of and mate with the shape of outwardly projecting ridge 326 of housing 314. Notch 368 can form a continuous, e.g., ovular, inwardly extending groove in the mating surface 362 of lid 312. Mating ridge 326 and notch 368, which can be sized to create a press-fit between themselves, also aid in creating a water resistant fit between lid 312 and housing 314 when the two are mated.

While fuse holder 310 of FIGS. 10 to 13 is described housing a male-type blade fuse 50, fuse holder 310, in an alternative embodiment, houses a different type of fuse, such as a low profile blade fuse or a female cartridge fuse. Also, while apertures or lumens 18*a* and 18*b* are shown being provided or defined solely by housing 314, lumens 18*a* and 18*b* are alternatively or additionally provided or defined by lid 312. Still further, fuse holder 310 may be configured to hold two or more fuses, for example, by stacking the apparatus shown in FIGS. 10 to 13 behind one or more other such apparatuses within the holder 310.

Figure 14:
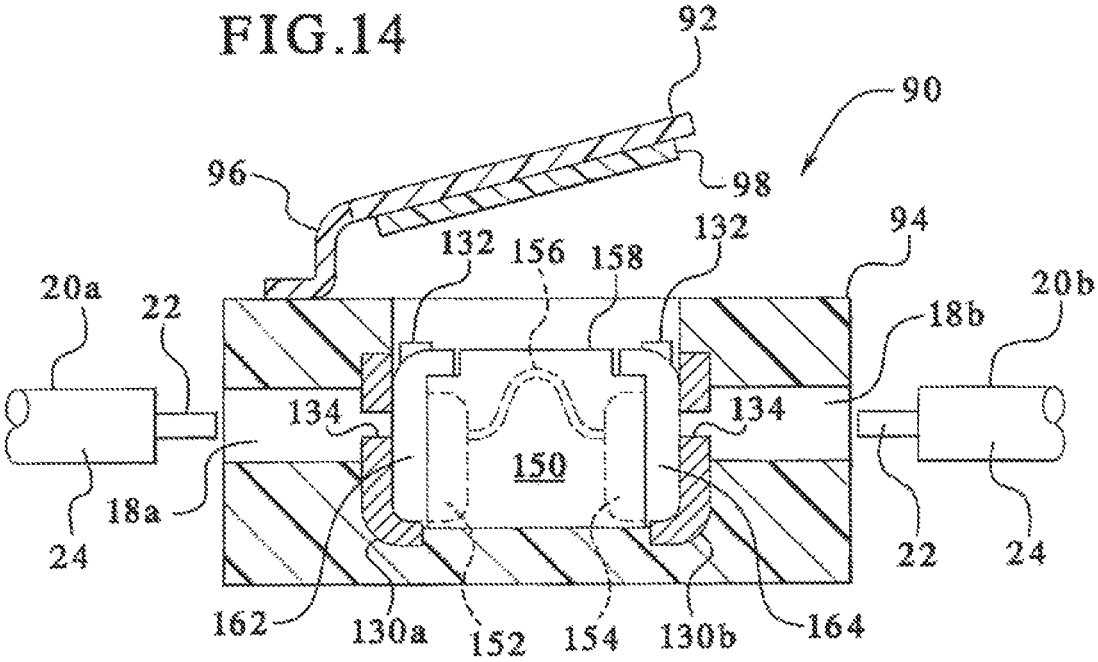
FIG. 14 is a sectioned elevation view of a low profile blade fuse showing one possible corresponding lead aperture/lumen and fuse cavity arrangement operable with each of the fuse holder embodiments illustrated in connection with FIGS. 1 to 13.

Referring now to FIG. 14, a low profile blade fuse 150 is shown along with one possible corresponding lead aperture or lumen and fuse cavity arrangement. Such lead aperture and fuse cavity arrangement is operable with each of the fuse holders 10, 60, 90, 110, 210 and 310 illustrated above in connection with FIGS. 1 to 13. For ease of illustration a fuse holder similar to that of fuse holder 90 of FIG. 3 is shown. Like element numbers are used accordingly. Holder 90 is shown sectioned, while fuse 150 is not sectioned.

Fuse 150 is a male-type automotive blade fuse having terminals 152 and 154 connected electrically via a fuse element or fuse link 156. Here, unlike fuse 50, fuse 150 does not include a portion of terminals 52 and 54 that extends beneath (or appreciably beneath) plastic or insulative housing 158. Housing 158 instead covers the entire (or almost entire) inner portion of terminals 52 and 54 and all of fuse element or fuse link 56. Housing 158, like housing 58 aids in the placement of fuse 150 into either a fuse block of an automobile or, in this case, the fuse holder 90 of the present invention. Housing 158 also as before contains the energy released upon an opening of link or element 156. Fuse 150 may be sized for any known current rating. One suitable low profile blade fuse is described in the '101 application referenced above.

As seen, the outer edges 162 and 164 of terminals 152 and 154 of fuse 150 are exposed. Also, as described in detail in the '101 application, the upper end edges of terminals 152 and 154 are bent over a portion of housing 158 to help hold the housing to the terminals. At least a portion of the bent upper end edges is also exposed and can be used as probe points for diagnostic purposes.

Outer edges 162 and 164 make electrical contact with elements 130*a* and 130*b* embedded within the cavity of housing 94 of fuse holder 90. Like before, elements 130*a* and 130*b* each include a plurality of crimping elements 132 that are spaced apart and mechanically hold outer portions 162 and 164 of terminals 152 and 154 of fuse 150 when fuse 150 is inserted into housing 94. Crimping members 132 hold fuse 150 snugly in place but also enable fuse 150 to be removed if element or link 156 opens, due, for example, an overcurrent condition. Crimping members 132 are conductive and are therefore in electrical communication with outer portions 162 and 164 of terminals 152 and 154.

Elements 130*a* and 130*b* also include connection sections 134 that are configured to connect to and hold fixed in electrical communication the conductive wire portions 22 of leads 20*a* and 20*b*. In one embodiment, once conductive ends 22 of leads 20*a* and 20*b* are crimped into connection sections 134 of elements 130*a* and 130*b*, leads 20*a* and 20*b* cannot thereafter be removed from lower housing 94. When leads 20*a* and 20*b* are crimped into sections 134 of elements 130*a* and 130*b*, respectively, and fuse 150 is inserted into lower housing 94, lead 20*a* is forced into electrical communication with terminal 152 of fuse 150, while lead 20*b* is forced into electrical communication with terminal 154 of fuse 150.

Figure 15:
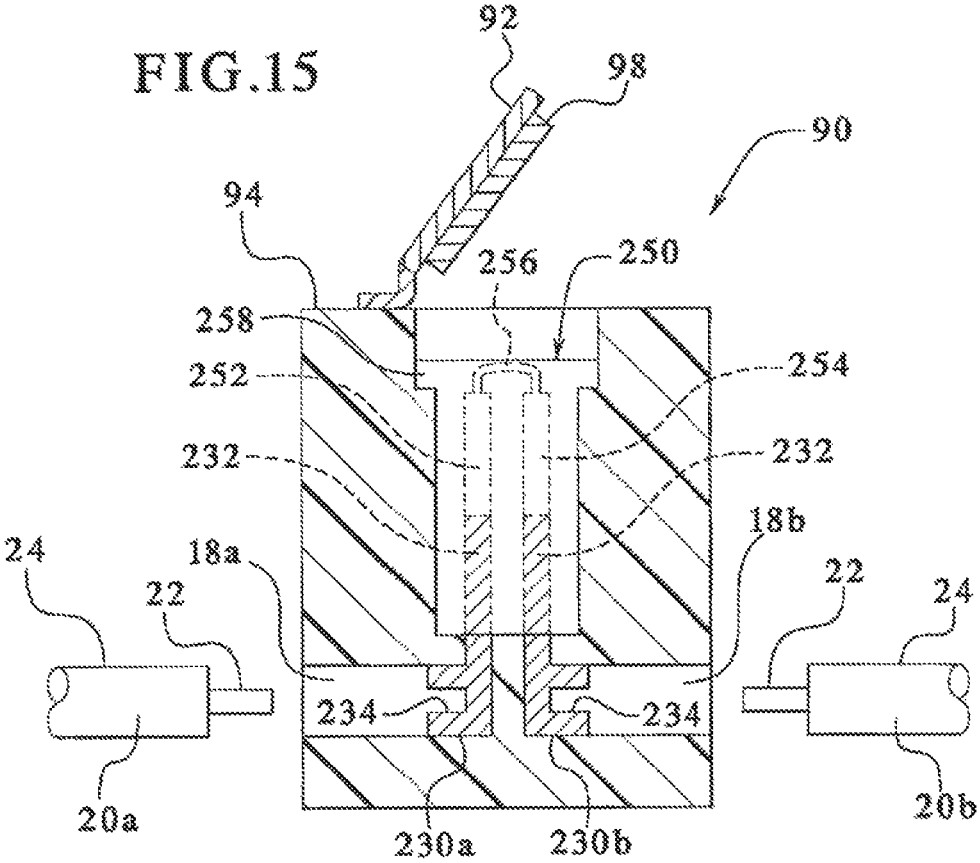
FIG. 15 is a sectioned elevation view of a cartridge fuse showing one possible corresponding lead aperture/lumen and fuse cavity arrangement operable with each of the fuse holder embodiments illustrated in connection with FIGS. 1 to 13.

Referring now to FIG. 15, a female cartridge fuse 250 is shown along with one possible corresponding lead aperture and fuse cavity arrangement. Such lead aperture and fuse cavity arrangement it should be appreciated are operable with each of the fuse holders 10, 60, 90, 110, 210 and 310 illustrated above in connection with FIGS. 1 to 13. For ease of illustration a fuse holder similar to that of fuse holder 90 of FIG. 3 is shown again. Like element numbers are used accordingly. Holder 90 is shown sectioned, while fuse 250 is not sectioned.

Fuse 250 is a female-type automotive cartridge fuse having terminals 252 and 254 connected electrically via a fuse element or fuse link 256. Cartridge fuse 252 can have more than two terminals, such as four terminals. Two terminals 252 and 254 are illustrated here for convenience. Housing 258 covers the terminals 252 and 254 entirely (or almost entirely) and all of fuse element or fuse link 256. Housing 258, like housings 58 and 258 aids in the placement of fuse 250 into either a fuse block of an automobile or, in this case, the fuse holder 90 of the present invention. Housing 258 also as before contains the energy released upon an opening of link or element 256. Fuse 250 may be sized for any known current rating. One suitable cartridge fuse is the J-Case® fuse (including the low profile J-Case® fuse) manufactured and sold by the assignee of the present invention.

Terminals 252 and 254 make electrical contact with elements 230*a* and 230*b* embedded within the cavity of housing 94 of fuse holder 90. Unlike before, elements 230*a* and 230*b* each include a male member 232 that snugly and holdingly fit within the female terminals 252 and 254 of fuse 250 when fuse 250 is inserted into housing 94. Male members 232 hold fuse 250 snugly in place but also enable fuse 250 to be removed if element or link 256 opens. Male members 232 are conductive and are therefore in electrical communication with terminals 252 and 254.

Elements 230*a* and 230*b* also include connection sections 234 that are configured to connect to and hold fixed in electrical communication the conductive wire portion 22, of leads 20*a* and 20*b*. In one embodiment, once conductive ends of leads 20*a* and 20*b* are crimped into connection sections 234 of elements 230*a* and 230*b*, leads 20*a* and 20*b* cannot thereafter be removed from lower housing 94. When leads 20*a* and 20*b* are crimped into sections 234 of elements 230*a* and 230*b*, respectively, and fuse 250 is inserted into lower housing 94, lead 20*a* is forced into electrical communication with terminal 252 of fuse 250, while lead 20*b* is forced into electrical communication with terminal 254 of fuse 250.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A fuse holder for a fuse comprising:

a first housing having a first aperture through an end wall of said housing and a first side; and a second housing forming a cavity configured to house the fuse, said second housing having a first side and a first aperture through an end wall of said housing wherein the end wall of the first housing overlaps the end wall of the second housing such that the first aperture through said first housing is aligned with said first aperture through said second housing, and the first side of the first housing overlaps the first side of the second housing to engage the first side of the second housing along a bottom edge thereof so as to hold the first and second housings together in a frictional and moisture resistant relationship.

2. The fuse holder of claim 1, wherein the first and second housings are made of at least one material selected from the group consisting of: plastic and rubber.

3. The fuse holder of claim 1, wherein the first aperture of the first housing and the first aperture of the second housing are configured to receive a first lead to be inserted into the cavity so as to be in electrical communication with a corresponding first terminal of the fuse.

4. The fuse holder of claim 3, wherein the terminal of the fuse extends below a body of the fuse, and wherein the cavity is configured in combination with the first and second apertures so that the first lead contacts the corresponding first terminal at a point below the body of the fuse.

5. The fuse holder of claim 3, wherein the first and second terminals of the fuse have side edges exposed from a body of the fuse, the first and second terminals not extending at least appreciably below the body, and wherein the cavity is configured in combination with the first and second apertures so that the first and second leads contact the first and second terminals at the exposed side edges of the terminals.

6. The fuse holder of claim 1, wherein the cavity is configured to hold a fuse of at least one type selected from the group consisting of: a blade fuse, a cartridge fuse and an automotive fuse.

7. The fuse holder of claim 1, wherein the first housing includes a second side that overlaps a second side of the second housing and engages the second side of the second housing along a bottom edge thereof, the engagement of the first and second sides of the first and second housings tending to hold the housings together in a frictional and moisture resistant relationship.

8. The fuse holder of claim 1, wherein the first side of the first housing includes a clip that engages a projection extending from the first side of the second housing, along the bottom edge of the second housing.

9. The fuse holder of claim 1, wherein the first and second housings are connected together via a strap.

10. The fuse holder of claim 9, wherein the strap has a first end connected to the fist side of the first housing and a second end connected to the first side of the second housing.

11. The fuse holder of claim 8 wherein the clip is a first clip and wherein the first housing includes a second side that overlaps a second side of the second housing and engages the second side of the second housing along a bottom edge thereof, said fuse holder further comprising a second clip extending from the second side of the first housing that engages a projection extending from the second side of the second housing, along the bottom edge of the second housing such that the first and second clips hold the first and second housings together in a frictional and moisture resistant relationship.

* * * * *